US012727727B2

(12) United States Patent
Bauer et al.

(10) Patent No.: US 12,727,727 B2
(45) Date of Patent: Sep. 8, 2026

(54) FLOOR CLEANING MACHINE AND METHOD FOR OPERATING A FLOOR CLEANING MACHINE

(71) Applicant: Alfred Kärcher SE & Co. KG, Winnenden (DE)

(72) Inventors: Ulrich Bauer, Winnenden (DE); Michael Mueller, Winnenden (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 471 days.

(21) Appl. No.: 18/166,904

(22) Filed: Feb. 9, 2023

(65) Prior Publication Data

US 2023/0180985 A1 Jun. 15, 2023

Related U.S. Application Data

(63) Continuation of application No. PCT/EP2021/072201, filed on Aug. 9, 2021.

(30) Foreign Application Priority Data

Aug. 10, 2020 (DE) ..... 10 2020 121 035.3

(51) Int. Cl.
*A47L 11/24* (2006.01)
*A47L 11/40* (2006.01)
*E01H 1/05* (2006.01)

(52) U.S. Cl.
CPC ..... *A47L 11/24* (2013.01); *A47L 11/4055* (2013.01); *A47L 11/4058* (2013.01); (Continued)

(58) Field of Classification Search
CPC ..... A47L 11/4052; A47L 11/4055; A47L 11/4058; A47L 11/4041; A47L 11/4063; (Continued)

(56) References Cited

U.S. PATENT DOCUMENTS 163,859 A 6/1875 Fishbaugh
1,638,591 A 8/1927 Merrill
(Continued)

FOREIGN PATENT DOCUMENTS

CN 107567516 A 1/2018
CN 110868899 A 3/2020
(Continued)

OTHER PUBLICATIONS

First Office Action issued May 8, 2025, in corresponding Chinese patent application No. 202180057667.3.

*Primary Examiner* — Laura C Guidotti
(74) *Attorney, Agent, or Firm* — Womble Bond Dickinson (US) LLP

(57) ABSTRACT

A floor cleaning machine is provided, including a base, a rocker which is arranged at the base via a first pivot bearing for pivotal movement about a first pivot axis, a sweeping roller which is arranged at the rocker via a rotary bearing for rotational movement about a rotary axis, a motor device for rotatably driving the sweeping roller, and a traction drive having a traction member for transmitting torque from the motor device to the sweeping roller, wherein the traction member includes a load-side section, wherein a lever is arranged at the base via a second pivot bearing for pivotal movement about a second pivot axis, wherein the lever is articulated to the rocker, and wherein a deflection element for the traction member is arranged at the lever, wherein the traction member is guided on the deflection element in the load-side section.

35 Claims, 10 Drawing Sheets

(52) U.S. Cl.
CPC ..... *A47L 11/4069* (2013.01); *A47L 11/4075* (2013.01); *E01H 1/056* (2013.01); *A47L 11/4041* (2013.01)

(58) Field of Classification Search
CPC .. A47L 11/4069; A47L 11/24; A47L 11/4005; A47L 9/0444; A47L 9/0494; A47L 9/066; A47L 9/0666; A47L 11/28; A47L 11/302; A47L 11/40; A47L 11/4075; A47L 11/4002; A47L 5/34; E04H 1/056
USPC ..... 15/41.1, 50.3, 52.1, 82
See application file for complete search history.

(56) References Cited

U.S. PATENT DOCUMENTS 3,892,003 A 7/1975 Peabody
4,351,078 A * 9/1982 Sternberg ..... A47L 11/18 451/352
4,531,249 A * 7/1985 Sternberg ..... A47L 9/0494 451/352
4,701,969 A * 10/1987 Berfield ..... A47L 11/4038 15/83
5,671,499 A * 9/1997 Melito ..... A47L 11/4025 15/377
5,715,567 A 2/1998 Tagliaferri
7,059,004 B2 * 6/2006 Mitchell ..... A47L 11/4055 15/49.1
2014/0144467 A1 5/2014 Merz et al.
2016/0138231 A1 5/2016 Kral et al.
2016/0309973 A1 * 10/2016 Sheikh ..... A47L 11/4072
2021/0093133 A1 4/2021 Massaro

FOREIGN PATENT DOCUMENTS

DE 200 07 910 U1 7/2000
DE 199 42 233 A1 3/2001
DE 10 2009 047 368 6/2011
DE 20 2013 105 493 U1 1/2014
DE 10 2014 006 392 B4 3/2018
DE 10 2020 109 656 A1 10/2021
DE 10 2020 109 694 A1 10/2021
GB 287 978 4/1928
WO 2018059713 A1 4/2018
WO WO 2019/001707 1/2019

* cited by examiner

FLOOR CLEANING MACHINE AND METHOD FOR OPERATING A FLOOR CLEANING MACHINE

CROSS-REFERENCE TO RELATED APPLICATIONS

This application is a continuation of international application number PCT/EP2021/072201, filed on Aug. 9, 2021, and claims the benefit of German application number 10 2020 121 035.3, filed on Aug. 10, 2020, which applications are incorporated herein by reference in their entirety and for all purposes.

BACKGROUND OF THE INVENTION

The invention relates to a floor cleaning machine, comprising a base, a rocker which is arranged at the base via a first pivot bearing for pivotal movement about a first pivot axis, a sweeping roller which is arranged at the rocker via a rotary bearing for rotational movement about a rotary axis, a motor device for rotatably driving the sweeping roller, and a traction drive having a traction member for transmitting torque from the motor device to the sweeping roller, wherein the traction member comprises a load-side section.

The invention further relates to a method for operating a floor cleaning machine.

DE 10 2014 006 392 B4 discloses a sweeping machine comprising a brush which can be driven in rotation by a motor and is supported for height adjustment, an automatic lowering and raising device for the brush, realized by driving the brush via a traction-side strand of a transmission element which is guided in such a way that, in operation, by generation of a torque, the transmission element applies a downwardly directed force on the brush, and realized by a preloaded mounting of the brush by which the brush experiences an upwardly directed force when the motor is at standstill condition, wherein the brush is supported on an adjusting lever which is supported for rotary movement about a pivot axis, and wherein the pivot axis divides the adjusting lever into a first lever arm on which the brush is supported, and a second lever arm on which a deflection element is supported, and wherein the traction-side strand of the transmission element which starts from the motor acts on the deflection element.

DE 10 2020 109 656.9, not prepublished, discloses a floor cleaning machine, in particular for cleaning floors comprising a textile material, the floor cleaning machine comprising a base, at least one cleaning roller unit which is rotatably arranged at the base, and a suction unit device, wherein the at least one cleaning roller unit has associated therewith a filter unit which is positionable as a whole on the floor cleaning machine, and is removable as a whole from the floor cleaning machine, and comprises a housing, at least a first filter and a second filter, wherein the first filter and the second filter are arranged at the housing, the first filter is a pre-filter for the second filter, and the first filter is formed as a fluff filter.

DE 10 2020 109 694.1, not prepublished, discloses a floor cleaning machine, comprising a base, at least one cleaning roller unit which is rotatably arranged at the base, and a motor device for driving the at least one cleaning roller unit in rotation. A height adjustment device is provided for the at least one cleaning roller unit. Furthermore, a detection device is provided for detecting a contact pressure of the at least one cleaning roller unit against a floor which is to be cleaned.

SUMMARY OF THE INVENTION

In accordance with an exemplary embodiment of the invention, a floor cleaning machine is provided which affords ease of operation with efficiency of cleaning.

In accordance with an exemplary embodiment of the invention, the floor cleaning machine comprises a base, a rocker which is arranged at the base via a first pivot bearing for pivotal movement about a first pivot axis, a sweeping roller which is arranged at the rocker via a rotary bearing for rotational movement about a rotary axis, a motor device for rotatably driving the sweeping roller, and a traction drive having a traction member for transmitting torque from the motor device to the sweeping roller, wherein the traction member comprises a load-side section, wherein a lever is arranged at the base via a second pivot bearing for pivotal movement about a second pivot axis, wherein the lever is articulated to the rocker, and wherein a deflection element for the traction member is arranged at the lever, wherein the traction member is guided on the deflection element in the load-side section.

By use of the floor cleaning machine in accordance with the invention, textile floors, and in particular carpeted floors, can be cleaned, although, in principle, smooth floors or hard floors can also be cleaned. Hard floors or smooth floors are, for example, tile floors, parquet floors, industrial screed floors, asphalt floors, cobblestone paved floors, PVC floors, etc. Different carpeted floors can have different levels of carpet pile. In principle, different floors may require different contact pressures of the sweeping roller against the floor to be cleaned in order to provide effective cleaning capability.

In the solution in accordance with the invention, automatic control for a cleaning operation, and in particular for a contact pressure of the sweeping roller against the floor to be cleaned, is realized via the pivotably arranged lever. Via the load-side section (traction-side section, or load-side strand or traction-side strand respectively), the motor device exerts a corresponding traction force in order to drive the rotation of the sweeping roller. By the action of the sweeping roller upon the floor to be cleaned, a counter torque is created which results in a force in the load-side section, or in a resultant traction tension in the load-side section. The resultant traction tension for a given sweeping roller depends on the type of the floor that is to be cleaned.

A corresponding action is present on the lever via the deflection element. The lever is articulated for pivotal movement about the second pivot axis, and it can then change its position depending on the force acting thereon, or its position is adapted to the force acting thereon. This, however, means that the position of the lever is predetermined by the floor type of the floor to be cleaned when the sweeping roller acts on the floor to be cleaned. By the articulation of the lever to the rocker, the lever in turn predetermines the pivotal position of the rocker on the base, and hence the position of the sweeping roller relative to the floor to be cleaned (and hence the contact pressure). This results in a control process which, with the appropriate configuration, leads to an optimized cleaning result. The control process can find application to all customary sweeping principles.

When, during a cleaning operation, an operator transitions between different floor types, for example from a first carpeted floor to a second, different carpeted floor, or from a carpeted floor to a smooth floor, or from a smooth floor to a carpeted floor, the contact pressure will automatically adjust depending on the particular floor type, and an optimized cleaning result is achieved. Automatic control and adaptation to the particular floor type is realized without the need for an operator to intervene.

In particular, the lever is articulated to the rocker via a third pivot bearing for pivotal movement about a third pivot axis. This makes for a simple way of effecting action on the rocker via the lever in order to predetermine the rocker's pivotal position on the first pivot bearing.

Simple construction is achieved if at least one of the following is provided:

- the rotary axis and the first pivot axis are oriented parallel to one another;
- the rotary axis and the second pivot axis are oriented parallel to each other;
- the first pivot axis and the second pivot axis are oriented parallel to one another;
- the rotary axis and/or the first pivot axis and/or the second pivot axis are transverse and in particular perpendicular to a forward travel direction of the floor cleaning machine;
- the rotary axis and/or the first pivot axis and/or the second pivot axis are parallel to a wheel axis of the floor cleaning machine;
- the rotary axis and/or the first pivot axis and/or the second pivot axis are transverse and in particular perpendicular to a height direction of the base, wherein a position of the sweeping roller in the height direction is adjustable via a pivotal position of the rocker on the first pivot bearing.

If one or more of the above is present, then this will afford a simple way of providing a mechanical control for the contact pressure of the sweeping roller against the floor to be cleaned, in particular wherein automatic adaptation to a particular floor type is realized.

For the same reasons, it is advantageous for the third pivot axis to be oriented parallel to the rotary axis and/or parallel to the first pivot axis and/or parallel to the second pivot axis.

It is advantageous if, relative to a longitudinal direction of the rocker, the first pivot bearing is positioned in spaced relation to the rotary bearing. This provides a way of adjusting the contact pressure using simple structure.

It is further advantageous if, relative to a longitudinal direction of the rocker, the first pivot bearing is positioned between the rotary bearing and the third pivot bearing. This provides a simple way of predetermining a pivotal position of the rocker on the first pivot bearing via the lever.

It is particularly advantageous for the lever to be arranged and configured such that a pivotal position about the second pivot axis predetermines a pivotal position of the rocker about the first pivot axis, and in particular predetermines at least one of the following:

- a height position of the sweeping roller relative to the base;
- a contact pressure of the sweeping roller against a floor to be cleaned;
- a width over which the sweeping roller acts on a floor to be cleaned.

An automatic control can thereby be achieved, in particular wherein an automatic adaptation to a particular floor type is realized.

For the same reason, it is advantageous for the lever to be arranged and configured such that, when in a cleaning mode in which the sweeping roller acts on a floor to be cleaned, a pivotal position of the lever on the second pivot bearing is adjusted via a resultant force in the load-side section (traction-side section, load-side strand) of the traction member, wherein the resultant force in the load-side section is determined by a torque of the sweeping roller on the floor to be cleaned. By virtue of the reaction force, or the reaction torque of the sweeping roller when acting on the floor to be cleaned, a resultant force is present in the load-side section, which resultant force brings about an adjustment of the pivotal position of the lever and thereby, in turn, a corresponding adjustment of a pivotal position of the rocker on the first pivot bearing. This in turn permits a control process to be performed in order to hold the sweeping roller in a position that is advantageous for effective cleaning, and in particular to bring the sweeping roller to an advantageous position when transitioning between floor types.

Correspondingly, via the traction drive, a positioning device is provided for positioning, via the rocker, the sweeping roller on a floor to be cleaned, wherein the positioning comprises automatic control via the lever. The positioning of the sweeping roller is predetermined by the pivotal position of the lever relative to the base.

In an exemplary embodiment configured with simple structure, the lever comprises a first web which is articulated to the base via the second pivot bearing, and comprises a second web which is connected to the first web via a fourth pivot bearing for pivotal movement about a fourth pivot axis and which is oriented transversely to the first web. This provides a simple way of acting upon the rocker via the lever in order to permit the rocker and hence, in turn, the sweeping roller, to be effectively positioned for a cleaning operation, relative to the floor to be cleaned.

In an embodiment, provision is made for the second web to be connected to the first web in translationally fixed relation thereto, or to be, relative to a translational position at the first web, adjustably connected to, and translationally fixed to, the first web. For example, when different translational positions are provided at the first web for the second web, then this will allow different levels of cleaning power to be predetermined, such as "low", "medium" and "high". Such a translational position can be adjusted, or altered, by an operator by way of a cable pull, for example.

It is then advantageous from a construction perspective for at least two discrete translational positions to be predetermined, in each of which the second web can be fixed to the first web in translationally fixed relation thereto. By way of example, three such translational positions are predetermined. Here, the second web can be pivoted relative to the first web in each translational position.

Provision is made for the second web to be coupled to the rocker in order to permit the pivotal position of the rocker to be adjusted correspondingly. Here, the coupling can be direct or indirect.

In an embodiment, the second web is directly pivotably articulated to the rocker, and, in particular, the second web is pivotably connected to the rocker via a third pivot bearing having a third pivot axis. This results in an embodiment which is simple in construction, and the number of components can be minimized.

In an alternative embodiment, the second web is pivotably articulated to an intermediate web, and the intermediate web is pivotably articulated to the rocker, in particular wherein the intermediate web is coupled to the rocker via a third pivot bearing for pivotal movement about a third pivot axis, and the second web is articulated to the intermediate web via a fifth pivot bearing for pivotal movement about a fifth pivot axis. An additional degree of freedom is thereby achieved. In particular, a mechanical switch can thereby be realized via which, depending on the switching position, a pivotability of the lever about the second pivot axis can be blocked or released. In particular, this provides a way of switching the automatic control process on or off.

It is advantageous from a construction perspective for the intermediate web to have a length between an articulation point to the second web and an articulation point to the rocker shorter than a length of the second web between an articulation point to the first web and the articulation point to the intermediate web. Thus, for example, a simple way is provided of realizing a toggle lever having a dead center position.

In particular, at least one of the following is provided:

- a mechanical switch is formed by way of the intermediate web, via which mechanical switch a pivotability of the lever about the second pivot axis can be blocked;
- the switch, and in particular the intermediate web, has at least one first position in which a pivotal mobility of the lever about the second pivot axis is blocked;
- in the at least one first position of the switch, and in particular of the intermediate web, the rocker is free to pivot about the first pivot axis;
- in the at least one first position, the second web is oriented at an acute angle to the first web;
- in the at least one first position, the intermediate web is oriented at an obtuse angle to the second web;
- the switch, and in particular the intermediate web, has at least one second position in which pivotability of the lever about the second pivot axis is enabled;
- in the at least one second position, the second web is oriented at an obtuse angle to the first web;
- in the at least one second position, the intermediate web is oriented at an acute angle to the second web;
- the second web and the intermediate web form a toggle lever, in particular wherein the at least one first position of the switch, and in particular of the intermediate web, is a dead center position of the toggle lever;
- the intermediate web comprises an engagement region for an operator which, in particular, is configured such that the intermediate web can be pushed and/or pulled by an operator.

By utilizing one or more of the features set forth above, a simple way is provided of coupling the lever to the rocker. Mechanical control is thereby made possible. By the provision of the intermediate web having the first position and the second position, and in particular by the formation into a toggle lever, a simple way is provided of realizing a mechanical switch in order to block or release automatic control (via the pivotal mobility of the lever about the second pivot axis).

In particular, by the provision of a dead center position of the toggle lever, the at least one first position of the switch (or of the intermediate web) is made simple to achieve, and, here, is simple to achieve from a construction perspective.

It is particularly advantageous for the deflection element to be located at the first web. In this way, via the resultant traction tension in the load-side section of the traction member, the first web can be correspondingly positioned in a particular pivotal position with respect to the base (on the second pivot bearing), wherein said pivotal position is dependent on the floor type of the floor to be cleaned. This, in turn, permits the pivotal position of the rocker on the first pivot bearing to be predetermined.

It is advantageous for the traction drive to have associated therewith a switch, and in particular a mechanical switch, by way of which a pivotal mobility of the lever about the second pivot axis can be blocked. Automatic mechanical control can thereby be "switched off".

In an embodiment, provision is made that, when the pivotal mobility of the lever is blocked by the switch, the rocker is supported for oscillating motion on the base, and the sweeping roller is therefore also supported for oscillating motion on the base.

It is advantageous for at least one of the following to be provided:

- the switch is configured as a pivoting switch;
- the switch has a dead center or dead center region, wherein, in the dead center or the dead center region, the pivotal mobility of the lever about the second pivot axis is blocked;
- the switch can be pushed in its pivotal movement and can be pulled in a pivotal movement by a user.

The switch can thereby be configured with simple structure. An operator is provided a simple way of operating the switch (when configured with simple structure) and of achieving blocking or unblocking of the pivotal mobility of the lever.

In an embodiment having simple construction, the rocker comprises a first arm and a spaced-apart second arm, wherein the sweeping roller is rotatably supported on the first arm and the second arm via the rotary bearing. This provides a simple way of achieving a two-sided rotary support of the sweeping roller on the rocker. Forces can thereby be transmitted in an optimized manner.

In an embodiment configured with simple structure, a bar is connected to the first arm and the second arm, and the bar is supported on the base for forming the first pivot bearing. Thus, a simple way is provided of realizing the first pivot bearing. A simple way is provided of configuring the first pivot bearing such that it can take up relatively large forces like those that appear during a cleaning operation. Convenient operation is provided if the bar is arranged in the area of a front end of the base, relative to a forward travel direction of the floor cleaning machine. In particular, optimal utilization of space on the floor cleaning machine is achieved. The bar can thereby be positioned, for example, outside of a dirt guiding path, external to a suction unit, etc.

In an embodiment configured with simple structure, the traction drive has, relative to the sweeping roller, a single-sided configuration. The number of components required can thereby be minimized. The need for synchronization and the like is obviated.

In an embodiment, the traction drive comprises a traction member tensioner which is arranged in a slack-side section of the traction member. A certain amount of traction member tension can thereby be achieved in the slack-side section, wherein said tension is less than that in the load-side section.

In particular, the traction drive comprises a drive element of the motor device, the deflection element at the lever, and an output element for the sweeping roller, and comprises the traction member, wherein the traction member is a closed loop traction member. In an embodiment, the traction drive comprises only the components set forth. However, additional components may be present.

In an embodiment, the traction drive additionally comprises a second deflection element which is arranged at the rocker. Here, the second deflection element is located in the load-side section (load-side strand) of the traction member. Optimized traction member guidance can be achieved for the particular application.

It is then particularly advantageous for the second deflection element to be arranged at the first pivot bearing, and, in particular, to be positioned in coaxial relation with the first pivot bearing. This provides a way of achieving at least approximately the effect that the rocker position will not be influenced by the traction member directly but only indirectly via the positioning of the lever about the second pivot axis.

In an embodiment, the second deflection element comprises a first track for the load-side section (load-side strand) of the traction member and a second track for a slack-side section (slack-side strand) of the traction member. For example, the second deflection element can thereby be utilized as a traction tensioner for the slack-side section. The number of components can thereby be minimized.

In particular, the traction member is a belt or a chain. The belt is a flat belt or a toothed belt, for example. A configuration with minimized slip is preferred. Here, the tension in the traction member should be selected to be just enough to transfer the resultant tension to the lever for the positioning thereof. If too much tension were experienced in the traction member, such "sensing" would be forfeited.

In an easy-to-operate embodiment, a rechargeable battery device is provided for providing electrical energy to the motor device and, optionally, to further energy-consuming elements of the floor cleaning machine. The floor cleaning machine can thereby be operated independently. It can also be operated at relatively low levels of noise emission.

For example, provision is made for a first receptacle for a first battery of the battery device to be arranged at the base and for a second receptacle for a second battery to be arranged at the base, separate from the first receptacle, wherein a first battery positioned at the first receptacle is operative with respect to the delivery of electrical energy to the motor device, and a battery positioned on the second receptacle is a replacement battery. This results in long run times with simple construction. In this respect, reference is made to non-prepublished German patent application No. 10 2020 109 694.1 of Apr. 7, 2020 of the same applicant. The content of this document is incorporated herein and made a part hereof by reference in its entirety and for all purposes.

In particular, at least one of the following is provided:

- the floor cleaning machine is configured as a sweeping machine for textile floors;
- a suction unit device is associated with the sweeping roller;
- a wheel device is arranged at the base for mobile operation of the floor cleaning machine;
- in operation of the floor cleaning machine, the floor cleaning machine is supported by the wheel device on the floor to be cleaned;
- the sweeping roller is positioned at the base, between a front end of the base and a rear wheel device;
- the floor cleaning machine is configured as a walk-behind machine or as a ride-on machine;
- a holder for an operator is arranged at the base, in particular wherein the holder is configured for a standing operator.

Thus, a floor cleaning machine configured with simple structure can be provided by a combination of one or more of the features set forth, which floor cleaning machine also allows effective cleaning of textile floors. The floor cleaning machine has relatively low noise emission during a cleaning operation.

It is advantageous for a dirt collection container to be provided to which dirt is conveyable from the sweeping roller, in particular with at least one of the following:

- the conveyance of dirt is assisted by a suction flow from a suction unit device;
- provision is made for an overthrow guide for dirt from the sweeping roller to the dirt collection container;
- the dirt collection container is removably arranged at the base;
- the dirt collection container is positioned on a rear side of the base.

In particular, by assistance by the suction flow, the emission of dust into the ambient environment during a sweeping operation can be minimized.

In principle, the control process in accordance with the invention can be applied to all customary operations of cleaning by sweeping action. A configuration having simple construction is achieved when an overthrow guide for dirt is provided from the sweeping roller to the dirt collection container.

The removability of the dirt collection container makes it easy to empty.

In accordance with an exemplary embodiment of the invention, a method for operating a floor cleaning machine in accordance with the invention is provided, in which method an action of the sweeping roller on a floor to be cleaned is mechanically controlled, wherein a pivotal position of the lever on the second pivot bearing is predetermined via an application of force on the load-side section of the traction member, and wherein the pivotal position of the lever on the second pivot bearing predetermines the position of the rocker on the first pivot bearing.

Predetermining the position of the rocker on the first pivot bearing, in turn, predetermines the position of the sweeping roller on the floor to be cleaned. Automatic adjustment can thereby be achieved.

A reaction force exerted by the floor on the sweeping roller is a measure of the floor type. This reaction force can be transferred to the lever as a traction tension via the load-side section. The lever is then correspondingly positioned and, in turn, transfers its positioning to the rocker.

The method in accordance with the invention has the advantages that have already been discussed in connection with the floor cleaning machine in accordance with the invention.

Further advantageous embodiments of the method in accordance with the invention have already been discussed in the context of the floor cleaning machine in accordance with the invention.

The following description of preferred embodiments serves in conjunction with the drawings to explain the invention in greater detail.

DETAILED DESCRIPTION OF THE INVENTION

Figure 1:
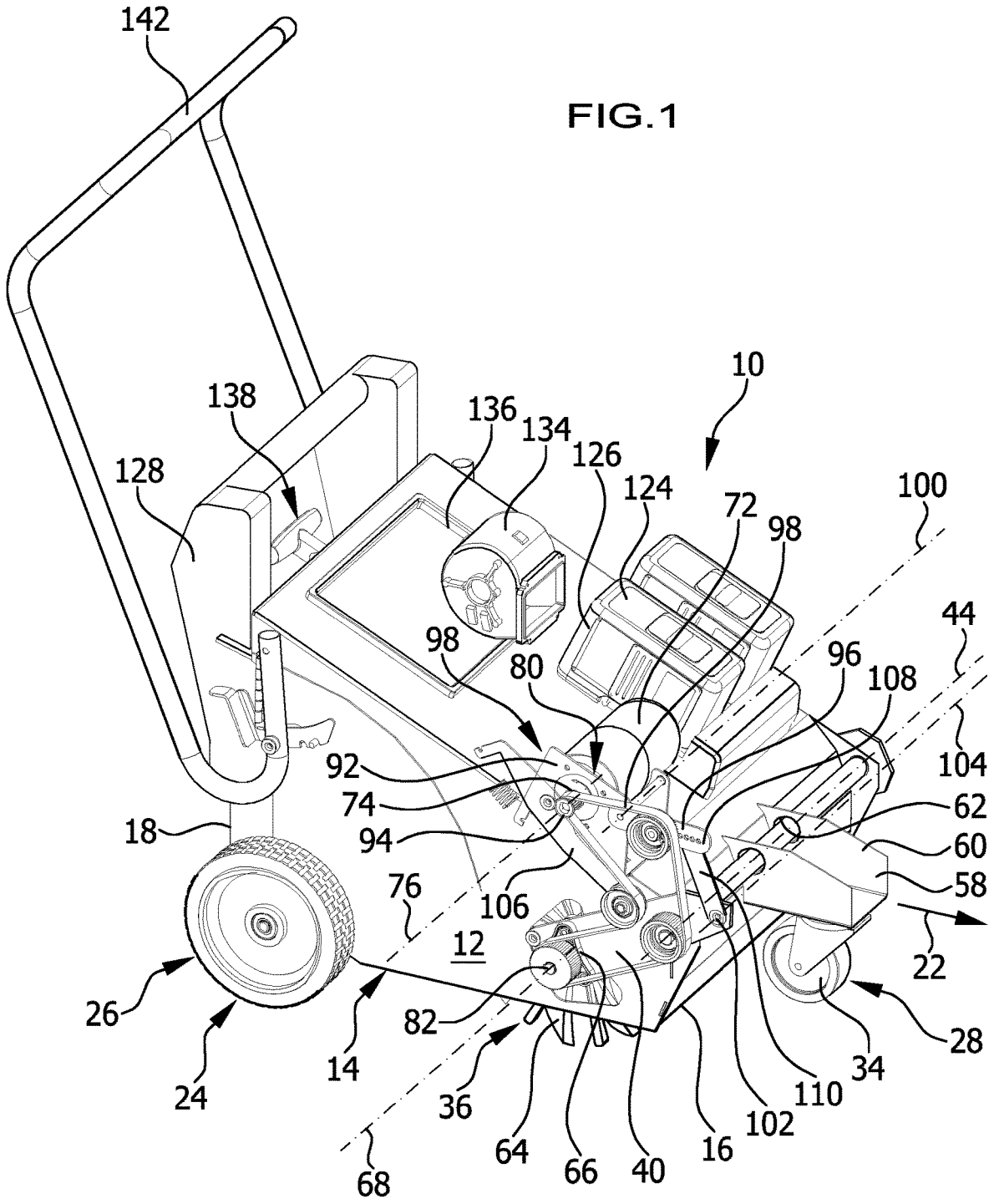
FIG. 1 shows, in perspective view, a first exemplary embodiment of a floor cleaning machine in accordance with the invention, wherein a housing cover has been removed.

A first exemplary embodiment (FIGS. 1 to 4) of a floor cleaning machine 10 in accordance with the invention comprises a base 12. The base 12 forms a main body of the floor cleaning machine 10.

In an embodiment, the base 12 is formed as a chassis 14.

The base 12 has a front end 16 and a rear end 18. The base 12 extends along an axis 20 (FIG. 2) between the front end 16 and the rear end 18.

Under the normally intended conditions of use of the floor cleaning machine 10 for cleaning a floor 23, the axis 20 is parallel to a forward (travel) direction 22 of the floor cleaning machine 10.

Arranged at the base 12 is a wheel device 24. The wheel device 24 comprises a rear wheel device 26 and a front wheel device 28. In an embodiment, the rear wheel device 26 comprises a left rear wheel 30*a* and a right rear wheel 30*b* (relative to a forward (travel) direction 22).

The rear wheel device 26 comprising the left rear wheel 30*a* and the right rear wheel 30*b* is arranged in the area of the rear end 18 of the base 12 (of the chassis 14).

The rear wheel device 26 comprising the left rear wheel 30*a* and the right rear wheel 30*b* has a common (geometric) wheel axis 32.

In an embodiment, the front wheel device 28 is formed by a roller 34. The roller 34 is arranged in the area of the front end 16.

In an embodiment, the roller 34 is configured in the form of a steerable roller.

A sweeping roller unit 36 is arranged at the base 12. The sweeping roller unit 36 is a main roller unit of the floor cleaning machine 10. One or more side brooms can be provided in addition to the sweeping roller unit 36 (this not being shown in the drawings).

The sweeping roller unit 36, in relation to the base 12, is positioned between the front end 16 and the rear end 18. In an embodiment, the sweeping roller unit 36 is positioned between the front wheel device 28 and the rear wheel device 26, with respect to the axis 20.

The sweeping roller unit 36 is arranged at the base 12 in such a way that a sweeping roller 64 of the sweeping roller unit 36 (see below) projects beyond an underside 38 of the base 12, at least when used in a cleaning mode.

Figure 2:
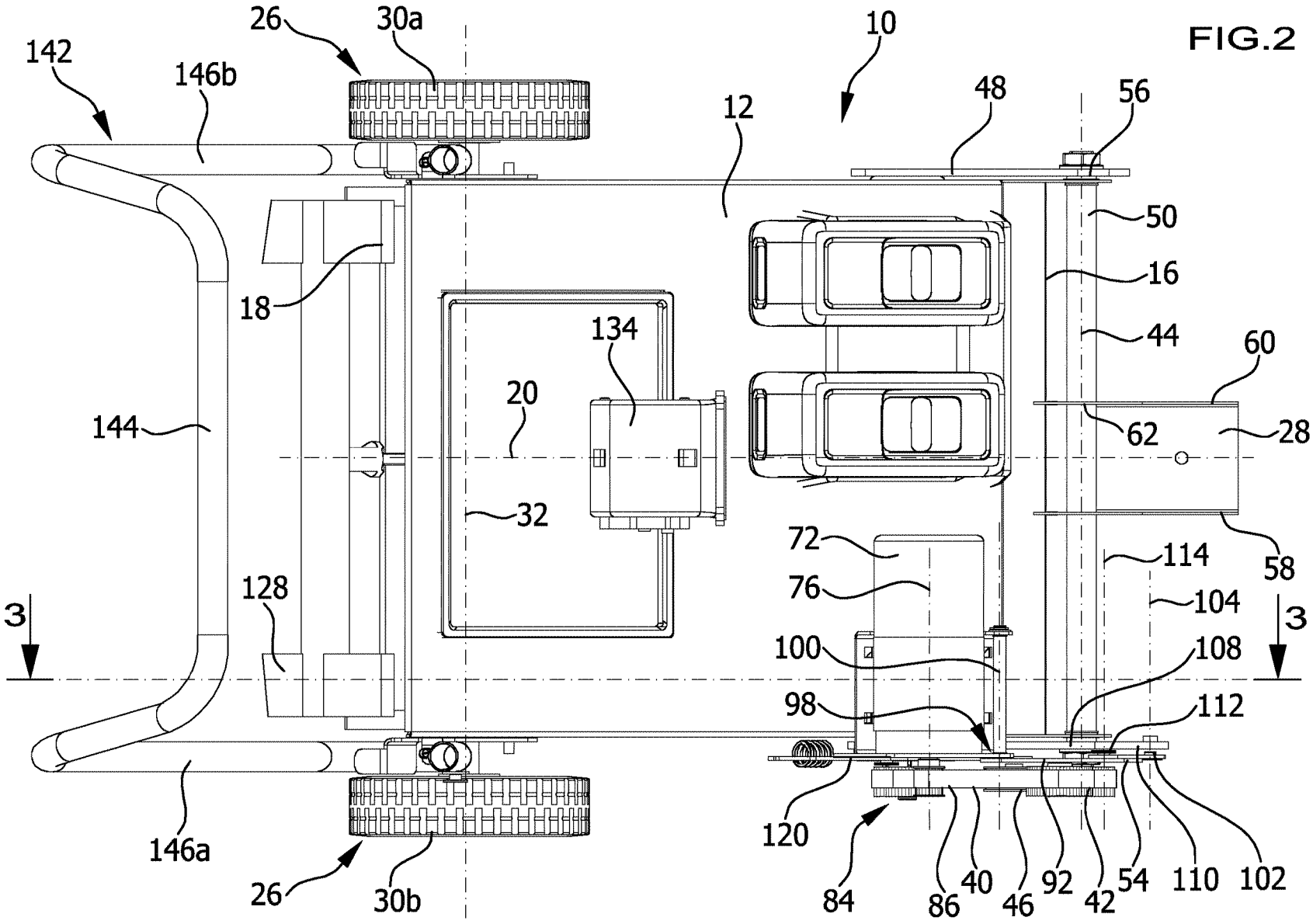
FIG. 2 shows a top plan view of the floor cleaning machine of FIG. 1.

A rocker 40 is supported on the base 12 via a first pivot bearing 42 for pivotal movement about a first pivot axis 44 (FIG. 2).

The first pivot axis 44 is oriented parallel to the wheel axis 32. It is oriented transversely and in particular perpendicularly to the direction of forward travel 22.

The first pivot axis 44 is oriented transversely to the axis 20 of the base 12.

Figure 4:
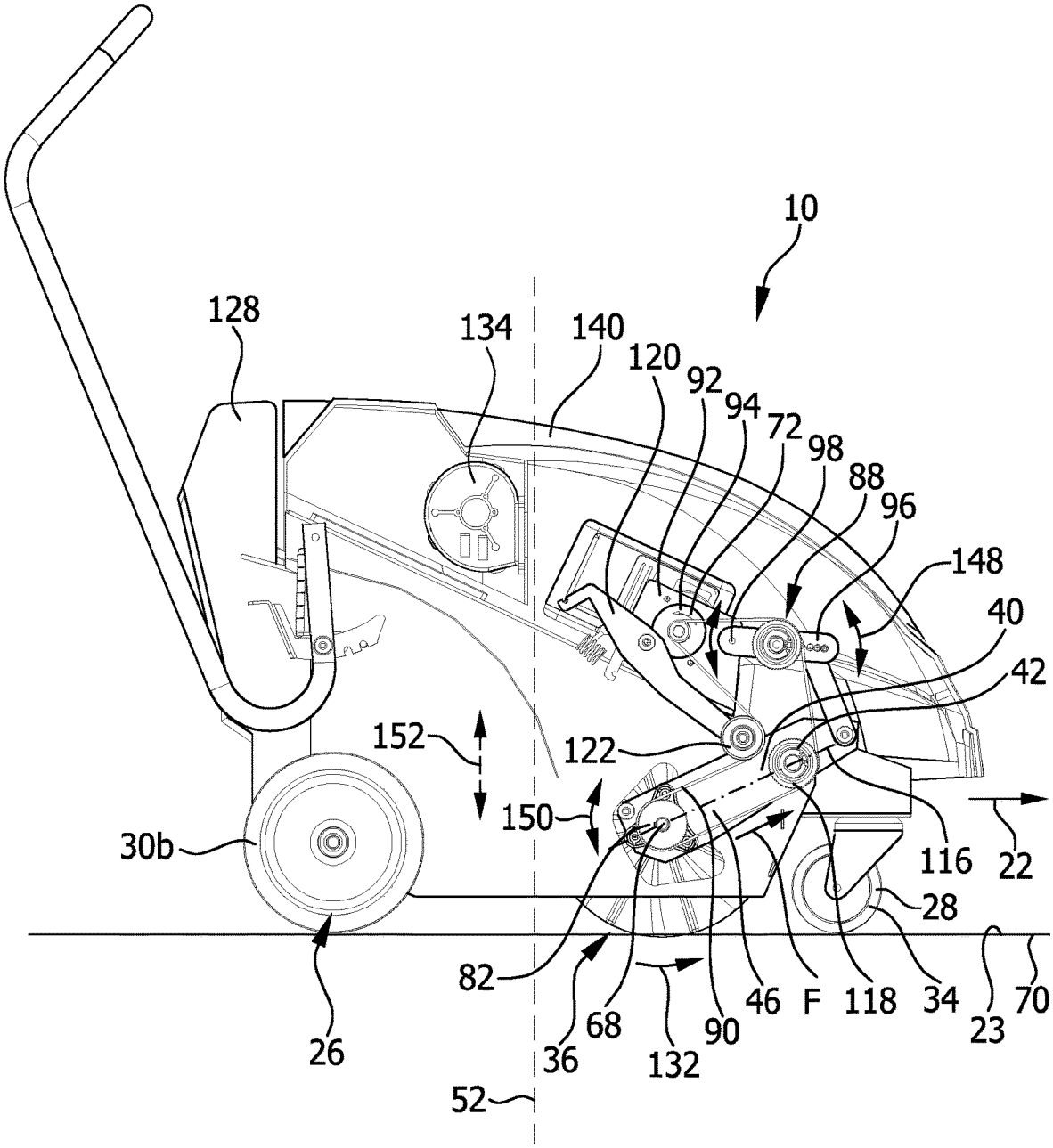
FIG. 4 shows a sectional side view of the floor cleaning machine of FIG. 1, with the housing cover mounted thereon.

In an exemplary embodiment, the rocker 40 comprises a first arm 46 and a second arm 48 in spaced parallel relation thereto. The first arm 46 and the second arm 48 are connected to one another via a bar 50 (FIG. 2). The bar 50 is located in the area of the front end 16 of the base 12, and is in particular located forward of the front end 16. Furthermore, in an exemplary embodiment, the bar 50 is oriented above the front wheel device 28, relative to a height direction 52 of the base 12 (FIG. 4). The height direction 52 is transverse and in particular perpendicular to the underside 38. When the floor cleaning machine 10 is properly positioned on the floor 23 that is to be cleaned, the height direction 52 is perpendicular to the floor 23.

The bar 50 extends coaxially with the first pivot axis 44.

The bar 50 is rotatably supported on the base 12 via a first lug 54 and a second lug 56 in spaced relation to the first lug 54. The bar 50 forms the first pivot bearing 42 of the rocker 40 via said rotatable support thereof.

The first arm 46 and the second arm 48 are each connected to the bar 50 in rotationally fixed relation thereto, and the bar 50 is supported on the base 12 for rotary movement about the first pivot axis 44 via the lugs 54, 56.

In an exemplary embodiment, a holder 58 is arranged at the base 12, in the area of the front end 16. The front wheel device 28 is mounted to the holder 58.

The holder 58, which is located centrally with respect to lateral sides of the base 12, comprises a lug device 60 (FIG. 1) which is provided with openings 62 therethrough. The bar 50 is extended through the openings 62.

Here, it is possible for the bar 50 to extend freely through the openings 62, or for a sliding bearing to be formed for the bar 50 at the holder 58, via the lug device 60.

The rocker 40 laterally engages over the base 12 with its first arm 46 and its second arm 48. The bar 50 is arranged forward of the front end 16 for that purpose.

The sweeping roller unit 36 comprises a sweeping roller 64 and a rotary bearing 66. The sweeping roller 64 is supported on the rocker 40 for rotation about a rotary axis (axis of rotation) 68 via the rotary bearing 66.

Here, the sweeping roller 64 is supported on both the first arm 46 and the second arm 48 via the rotary bearing 66.

The sweeping roller unit 36 follows a pivotal movement of the rocker 40 about the first pivot axis 44 relative to the base 12.

In the illustrated exemplary embodiment, the sweeping roller 64 has a one-piece configuration.

The sweeping roller 64 is provided with bristles. In particular, the bristles are configured such that a textile floor, and in particular a carpeted floor, can be cleaned via the floor cleaning machine 10.

The rotary axis 68 of the rotary bearing 66 for rotating the sweeping roller 64 is parallel to the first pivot axis 44. It is parallel to the wheel axis 32.

Furthermore, the rotary axis 68 is oriented transversely and in particular, here, perpendicularly to the axis 20 of the base 12.

Further, in particular, the rotary axis 68 is oriented parallel to the floor 23 to be cleaned when, for operating the floor cleaning machine 10 for cleaning action, the floor cleaning machine 10 is properly supported on the floor 23 via the wheel device 24.

Figure 3:
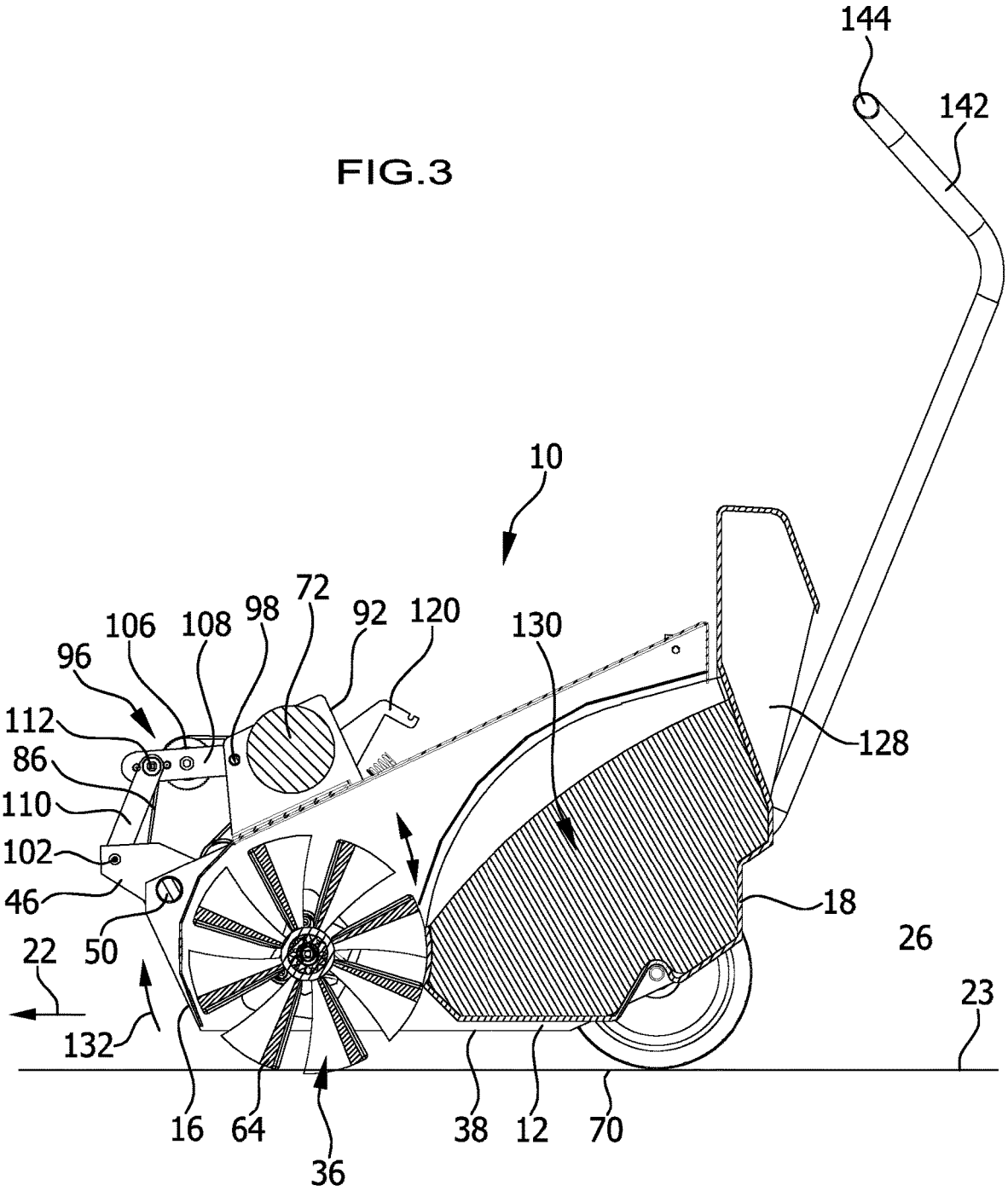
FIG. 3 shows a sectional view along line 3-3 of FIG. 2.

The floor cleaning machine 10 has a plane of support 70 (FIGS. 3, 4). The plane of support 70 is predetermined by the rear wheel device 26 and the front wheel device 28. When the floor cleaning machine 10 is properly supported on a planar floor 23 to be cleaned, the plane of support 70 is coincident with the plane of the floor 23 to be cleaned. The wheel axis 32 is parallel to the plane of support 70. The rotary axis 68 is parallel to the plane of support 70 (and, here, in spaced relation to the plane of support 70) in the height direction 52; the height direction 52 is perpendicular to the plane of support 70.

A motor device 72 is provided to impart rotational drive to the sweeping roller 64. The motor device 72 comprises an electric motor. The electric motor is fixedly arranged at the base 12 via a holder.

In an exemplary embodiment, the motor device 72 comprises a motor shaft 74 having an axis of rotation 76 (FIG. 1). The axis of rotation 76 is parallel to the rotary axis 68 of the sweeping roller 64.

In particular, the motor device 72 is arranged above the sweeping roller 64, relative to the height direction 52. Further relative to the height direction 52, in the illustrated embodiment, the motor device 72 is positioned above the rocker 40 at the base 12.

The floor cleaning machine 10 comprises a drive device 78. The drive device 78 comprises the motor device 72. Here, the motor shaft 74 is a drive shaft of the drive device 78.

The drive device 78 further comprises a torque transmission device 80 by which torque from the motor device 72 can be transmitted to the sweeping roller 64 for rotation thereof about the rotary axis 68. To this end, the sweeping roller 64 is provided with a corresponding shaft 82, which shaft 82 is supported by the pivot bearing 66. The shaft 82 forms an output shaft of the drive device 78.

The drive shaft 74 and the output shaft 82 are spaced apart one from the other, and in particular, here, are spaced apart from one another in the height direction 52. They can also be in spaced relation to one another relative to the axis 20, or they can be aligned in an in-line configuration with respect to the axis 20.

The torque transmission device 80 is configured as a traction drive 84 (also referred to as a traction drive mechanism or a drive mechanism comprising a closed-loop flexible traction member). The traction drive 84 comprises a traction member 86. The torque of the motor device 72 is transmitted, via the traction member 86, to the sweeping roller 64 for rotation thereof about the rotary axis 68. Here, the traction member 86 travels in a closed loop. In particular, the traction member 86 is a closed loop belt or a closed loop chain.

Here, the traction member 86 comprises a load-side section 88 (load-side strand or traction-side strand) and a slack-side section 90. Here, force is transferred from the motor device 72 to the shaft 82 via the load-side section 88 (load-side strand). The slack-side section 90 (slack-side strand) is, in a sense, the return portion of the traction member 86 travelling in a closed loop configuration.

In principle, the traction drive 84 can be configured as a force-locking drive or a form-locking drive.

In an embodiment, illustrated in FIGS. 1 to 4, one single traction drive 84 is associated with the rocker 40, and, here, is associated with only one arm of the rocker 40. In the illustrated embodiment, the traction drive 84 is associated with only the first arm 46. The sweeping roller 64 is then driven from only one side. This makes for a simple and compact construction, which saves space and components.

It is, in principle, also possible for the sweeping roller 64 to be driven in its rotary movement about the rotary axis 68 from both of its sides when a functionality for correspondingly synchronizing operation of the drive is provided (this not being shown in the drawings).

Arranged at the base 12, spaced apart from the underside 38 thereof, is a holder 92 which is, in particular, of plate-shaped configuration. The motor device 72 is arranged on one side of the holder 92. Arranged on the other side of the holder 92, at the shaft 74 of the motor device 72, is a roller 94 which is connected to the motor shaft 74 in rotationally fixed relation therewith and on which the traction member 86 is guided.

Articulated to the holder 92 via a second pivot bearing 98 is a lever 96 for pivotal movement thereof about a second pivot axis 100 (compare FIG. 1 in particular).

The lever 96 is thereby pivotably articulated to the base 12.

Further, the lever 96 is articulated to the rocker 40, and, here, is articulated to the first arm 46 of the rocker 40, via a third pivot bearing 102 for pivotal movement about a third pivot axis 104.

The second pivot axis 100 and the third pivot axis 104 are parallel to each other. They each lie parallel to the first pivot axis 44. Further, they each lie parallel to the rotary axis 68 and the axis of rotation 76.

Located at the lever 96 is a deflection element 106 which, in particular, is a deflection roller and on which the traction member 86 is guided, and, here, is guided in the load-side section 88.

In an exemplary embodiment (FIGS. 1 to 4), the lever 96 comprises a first web (bridge or link) 108 and a second web (bridge or link) 110. The first web 108 is articulated to the base 12 (the holder 92) via the second pivot bearing 98. The second web 110 is articulated to the rocker 40, and, here, to the first arm 46 of the rocker 40, via the third pivot bearing 102.

The first web 108 and the second web 110 are connected to each other via a fourth pivot bearing 112 for pivotal movement about a fourth pivot axis 114.

The fourth pivot axis 114 is parallel to the third pivot axis 104 and is parallel to the second pivot axis 100.

The deflection element 106 is positioned at the first web 108.

The lever 96 is coupled to the rocker 40 via the second web 110, and, here, is coupled such that, relative to a longitudinal direction 116 (FIG. 4) of the rocker 40 at the first arm 46 thereof, the first pivot bearing 42 is located between the rotary bearing 66 and the third pivot bearing 102.

The lever 96 is coupled to the rocker 40 such that a pivotal position of the rocker 40 on the first pivot bearing 42, and hence a position of the sweeping roller 64 in the height direction 52, can be adjusted via the lever 96.

In principle, it is possible for the second web 110 to be pivotably connected to the first web 108 while being translationally fixed with respect to the first web 108.

In the illustrated exemplary embodiment in accordance with FIGS. 1 to 4, a translational position of the second web 110 at the first web 108 can be adjusted. By way of example, the second web 110 is provided with a pin, and the first web 108 comprises a plurality of discrete, spaced-apart openings each of which can receive therein the pin of the second web 110. Pivotability about the fourth pivot axis 114 is enabled in each of these positions.

By virtue of the different translational positions of the second web 110 on the first web 108, different positions (working positions) can be predetermined for the sweeping roller 64 with respect to the height direction 52. In particular, these can be working positions for carpeted floors having different pile heights or for providing effective cleaning capability for a smooth floor.

A second deflection element 118 of the traction drive 84 is arranged at the rocker 40, and, here, is arranged at the first arm 46 of the rocker 40. The second deflection element 118, which is configured as a deflection roller in particular, is in particular arranged at the first pivot bearing 42 and is preferably arranged in coaxial relation to the first pivot axis 44.

The traction member 86 is guided in the load-side section 88 via the second deflection element 118.

The traction drive 84 comprises a traction member tensioner 120. The traction member tensioner 120 is, for example, fixably pivotably arranged on the holder 92 (with a pivot axis parallel to the first pivot axis 44). The traction member tensioner 120 comprises a further deflection element 122, in particular in the form of a deflection roller. Here, the traction member tensioner 120 acts on the slack-side section 90 of the traction member 86.

The closed loop traction member 86 is guided in a closed loop via the roller 94 at the motor shaft 74 (drive shaft), the deflection element 106 at the lever 96, the second deflection element 118 at the rocker 40, a corresponding guide element at the shaft 82 (output shaft), and the further deflection element 122 of the traction member tensioner 120.

Force transfer from the motor device 72 to the sweeping roller 64 occurs in the load-side section 88 which, in the traction member 86, extends from the roller 94 to the deflection element 106, to the second deflection element 118, and to the corresponding element at the shaft 82.

The remaining portion of the traction member 86 is the slack-side section 90, which then extends between the element at the shaft 82 and the motor shaft 74, wherein the traction member tensioner 120 located therebetween in the slack-side section 90, via the further deflection element 122 thereof, acts on the traction member 86 to establish a certain amount of bias therein.

In an embodiment, a battery device 124, and in particular a rechargeable battery device 124 (accumulator device), is provided for operating the motor device 72 (and other energy-consuming components of the floor cleaning machine 10). The battery device 124 is arranged at a receptacle 126 at the base 12.

Here, it is in principle possible for a plurality of receptacles to be present and, for example, for a non-operative battery device to be arranged at one of the receptacles as a replacement battery device. In this respect, reference is made to non-prepublished German patent application No. 10 2020 109 694.1 of Apr. 7, 2020 of the same applicant. The content of this document is incorporated herein and made a part hereof by reference in its entirety and for all purposes.

A dirt collection container 128 is removably arranged at the base 12. The dirt collection container 128 is arranged such that dirt can be "thrown" from the sweeping roller 64 and into the dirt collection container 128 while being guided in an overthrow guide 130 (FIG. 3).

In operation of the floor cleaning machine 10, the sweeping roller 64 rotates in a direction 132 (FIG. 3). Dirt is picked up by bristles of the sweeping roller 64 and carried along therewith in the direction of rotation 132 and is thrown therefrom into the dirt collection container 128 while being guided by the overthrow guide 130.

The direction of rotation 132 of the sweeping roller 64 about the rotary axis 68 thereof is such that, in the overthrow guide 130, dirt is, in a sense, thrown from above (relative to the height direction 52) into the dirt collection container 128. In the area of contact of the sweeping roller 64 with the floor 23 to be cleaned, the direction of rotation 132 is oriented parallel to the direction of forward travel 22.

A suction unit device 134 is arranged at the base 12. The suction unit device 134 generates a suction flow. The suction flow generated by the suction unit device 134 assists the conveyance of dirt into the dirt collection container 128. An essential function of the generated suction flow is to minimize the amount of dust contamination of the ambient environment and, in a sense, to channel the transfer of dirt particles that are "thrown off" from the sweeping roller 64 into the dirt collection container 128.

Associated with the suction unit device 134 is a filter unit 136 which can be cleaned via a filter cleaning device 138, and can for example be cleaned manually. The filter cleaning can be effected, for example, by shaking the filter unit 136 or by applying a flow of air to the filter unit 136. The filter cleaning can be manually triggered and manually driven. It can be manually triggered and automatically driven, or it can be automatically triggered and automatically driven.

With regard to the structure of an exemplary embodiment of a filter unit 136, reference is made to non-prepublished German patent application No. 10 2020 109 656.9 of Apr. 7, 2020 of the same applicant. The content of this document is incorporated herein and made a part hereof by reference in its entirety and for all purposes.

A housing cover 140 (FIG. 4) is provided for covering the top, front and lateral sides of the base 12. The housing cover has been removed from the representation in FIGS. 1 to 3.

In an embodiment (not depicted in the drawings), at least one side broom is arranged at the base 12. In particular, the side broom projects laterally beyond a lateral side associated therewith. Via the side broom, near-edge cleaning can be performed (for example, along an edge or along a skirting board). The side broom is driven in rotation about an axis of rotation. A corresponding drive is provided for this purpose, which drive is supplied with electrical energy via the battery device 124.

The suction unit device 134 is also supplied with electrical energy via the battery device 124.

It is, in principle, also possible for a side broom to be driven via the motor device 72.

The side broom is arranged, for example, in the area of the front end 16 of the base 12.

A holder (loop) 142 for an operator, and in particular a standing operator, is arranged at the base 12. The holder 142 is arranged in the area of the rear end 18.

The floor cleaning machine 10 is then configured as a walk-behind machine, wherein an operator standing behind the floor cleaning machine 10 pushes same via the holder 152 over a floor 23 to be cleaned.

In an embodiment, the holder 142 comprises a holding bar 144 which is in spaced relation to the base 12. The holding bar 144 is connected to the base 12 via a first strut **146*a* and a second strut 146*b* spaced from the first strut 146*a***.

In an embodiment, the holder 142 is pivotably arranged at the base 12. The holder 142 may thereby be adapted to the body height of an operator (of a standing operator). Furthermore, in a stowed position of the floor cleaning machine 10, the holder 142 can be folded down over the base 12, and in particular over the housing cover 140, in order to thus be able to reduce the dimensions of the floor cleaning machine 10 in the height direction 52 and the longitudinal dimensions along the axis 20.

The floor cleaning machine 10 works as follows:

In operation of the floor cleaning machine 10, the motor device 72 is activated. The motor shaft 74 rotates about the rotary axis 76. The shaft 82 is driven via the traction drive 84 comprising the traction member 86, and the sweeping roller 64 rotates in the direction of rotation 132. The sweeping roller 64 acts on a floor 23 to be cleaned, and dirt picked up from the floor 23 is carried along therewith.

Dirt carried along with the sweeping roller 64 is thrown therefrom into the dirt collection container 128.

The transfer of dirt into the dirt collection container 128 is assisted by the suction flow created by the suction unit device 134. In particular, dust contamination of the ambient environment is minimized by virtue of the suction flow.

An operator stands behind the floor cleaning machine 10 and manoeuvres same via the holder 142 over the floor 23 to be cleaned, in particular in the forward travel direction 22.

In principle, the sweeping roller 64 is configured such that it is capable of cleaning textile materials and, in particular, carpeted floors. In principle, a cleaning result is determined by a contact pressure with which the sweeping roller 64 acts on the textile material of the floor to be cleaned. The contact pressure determines a width over which the sweeping roller 64 acts on the textile material. Generally, it is useful for different contact pressures (effective widths) to be used for different textile materials having different pile heights, in order to allow an optimized cleaning result to be achieved. Furthermore, it is also desirable to have the ability to effectively clean smooth floors or hard floors with use of the floor cleaning machine 10.

By virtue of the traction drive 84 comprising the lever 96, a positioning device for the sweeping roller 64 is provided by way of which automatic adjustment of a position of the rocker 40 relative to the height direction 52 (and hence to the base 12) is achieved, and is in particular achieved using automatic control. This in turn provides, via automatic control, adjustment of the contact pressure, or the effective width, of the sweeping roller 64. An operator can thereby traverse different floors, with a good cleaning result being automatically achieved. By way of example, an operator can transition from a floor comprising a textile material having a first pile height, via a smooth floor, to a floor comprising a textile material having a second pile height, the second pile height being different from the first pile height, wherein effective cleaning is realized on each floor area. Here, the operator is relieved of the burden of adjusting the positioning device; this occurs automatically, in a control process.

In a cleaning operation, the sweeping roller 64 experiences torque due to its action on the floor 23 to be cleaned. This gives rise to a corresponding (reaction) force F being present in the load-side section 88 (compare FIG. 4). Force F is transferred to the lever 96 via the deflection element 106. Depending on the magnitude of force F, this can cause repositioning of the lever 96 on the second pivot bearing 98. Such repositioning of the lever 96, and hence of the first web 108, in turn acts on the rocker 40 via the second web 110. This can lead to the rocker 40 repositioning about the first pivot axis 44. This in turn repositions the sweeping roller 64 in the height direction 52 relative to the base 12. Here, such repositioning is effected until a corresponding equilibrium of forces exists.

With appropriate predetermination of a working point, an optimized cleaning result is then achieved.

The working point can be predetermined and adjusted by a stepped arrangement of the second web 110 relative to the first web 108 via the openings thereof. Here, such predetermination is not changed during operation.

If, for example, in a cleaning mode of the floor cleaning machine 10, the latter traverses from a carpeted floor to a smooth floor, the reaction torque on the sweeping roller 64 will generally be reduced. This causes the first web 108 to undergo downward motion about the second pivot axis 100, in a direction towards the floor 23. Such movement is transmitted to the second web 110, which then correspondingly causes upward pivoting of the rocker 40, in a direction away from the floor 23. As a result of this, the contact force is reduced, or the width over which the sweeping roller 64 is acting on the floor 23 is reduced.

If, for example, the floor cleaning machine 10 is brought from a smooth floor to a textile floor or from one textile floor to another, higher pile height textile floor, the reaction torque on the sweeping roller 64 will increase. Force F increases. This causes the first web 108 to undergo upward pivotal movement about the second pivot axis 100 (in a direction away from the floor 23). This causes the second web 110 to be driven upwardly, and this in turn causes the rocker 40 to pivot in a direction towards the floor 23. As a result of this, the contact pressure is increased, or the width over which the sweeping roller 64 is acting on the floor 23 is increased.

The lever 96 at which the deflection element 106 is located can be pivoted on the base 12. This is indicated by the double arrow designated by the reference numeral 148 in FIG. 4. This movement is transferred to the rocker 40 by way of the second web 110. This is indicated by the double arrow designated by the reference numeral 150 in FIG. 4.

This in turn allows a height position of the sweeping roller 64 relative to the base 12 to be adjusted, and, here, to be adjusted automatically, and, in particular, to be adjusted in an automatic control process, for an optimized cleaning result.

This capability of adjustment of the height position is indicated in FIG. 4 by the double arrow 152, shown in broken lines.

In accordance with the invention, a mechanical, automatic sweeping roller control is provided via the traction drive 84 comprising the lever 96 and the deflection element 106. Tension is applied via the load-side section 88 (load-side strand) of the traction member 86, which tension acts on the lever 96 and positions same correspondingly. An optimized cleaning performance is thereby automatically achieved on different types of ground surfaces without the need for the operator to perform a readjustment procedure.

By way of example, a toothed belt or a chain is used as the traction member 86. High efficiency and, hence, a long run time of the battery device 124 is thereby achieved. The corresponding torque transmission device 80 is low-maintenance.

A capability of adjustment can be achieved in a simple way via the position of the second web 110 on the first web 108, or the configuration of the lever 96. By way of example, a stepped adjustment for normal, light or heavy soiling is thereby possible.

In the exemplary embodiment of a belt as the traction member 86, the deflection element 106 is a belt pulley. A tension in the traction member 86 (in the case of a belt: the belt tension) determines the position of the lever 96 with respect to the second pivot axis 100.

In principle, it is desirable to minimize slip in a traction drive 84 so that, in particular, a toothed belt providing a force-locking coupling, or a chain are advantageously used as the traction member 86.

A typical diameter for the sweeping roller 64 is 250 mm.

By the solution in accordance with the invention, the sweeping roller 64 can be effectively prevented from "digging" into a carpet, thereby preventing poor cleaning performance and unnecessarily high energy consumption. The traction drive 84 is self-adjusting according to the tension in the traction member 86.

The traction member tensioner 120 acts in the slack-side section 90 (slack-side strand) of the traction member, which slack-side section 90 has a correspondingly small belt tension as compared to the belt tension in the load-side section 88.

The traction drive 84 is configured and dimensioned such that force transmission can occur through tension in the traction member, for positioning the lever 96.

The floor cleaning machine 10 has been discussed as a hand-guided and, in particular, hand-pushed walk-behind machine.

The solution in accordance with the invention for the automatic control of the positioning of the sweeping roller 64 relative to a floor 23 to be cleaned can also find use in, for example, a floor cleaning machine with propelling drive, and in particular in a self-propelled floor cleaning machine.

A second exemplary embodiment of a floor cleaning machine in accordance with the invention, shown in FIGS. 5 to 8 and designated therein by the reference numeral 154, is configured in generally the same manner as the floor cleaning machine 10. In the floor cleaning machine 154, those elements which are identical to those of the floor cleaning machine 10 are given the same reference numerals. The floor cleaning machine 154 can be regarded as a variant of the floor cleaning machine 10, said variant comprising an additional switch. The floor cleaning machine 154 comprises a traction drive 84' that has been modified as compared to the traction drive 84. The configuration differs essentially in the configuration of the second web 110' and the articulation thereof.

As has been described above in the context of the second web 110, the second web 110' is articulated to the first web 108 for pivotal movement about the fourth pivot axis 114, and, in particular, with respect to a translational position of the second web 110' at the first web 108, the corresponding position of the second web 110' is adjustable.

An intermediate web (intermediate bridge or intermediate link) 156 is provided which is articulated to the rocker 40 via a third pivot bearing 102'. The corresponding third pivot axis of the third pivot bearing 102' is parallel to the rotary axis 68.

The intermediate web 156 is articulated to the second web 110' via a fifth pivot bearing 158 for pivotal movement about a fifth pivot axis. A fifth pivot axis associated with the fifth pivot bearing 158 is parallel to the fourth pivot axis, or the third pivot axis, or the second pivot axis, or the first pivot axis, or the rotary axis 68.

Figure 6:
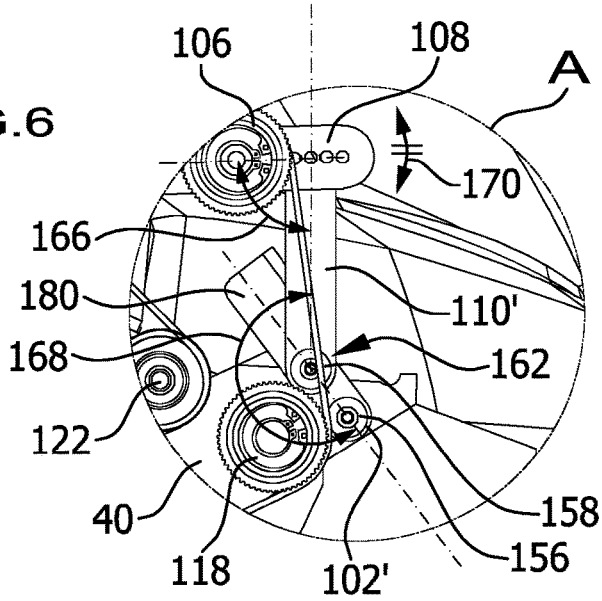
FIG. 6 shows an enlarged representation of detail A of FIG. 5.
Figure 8:
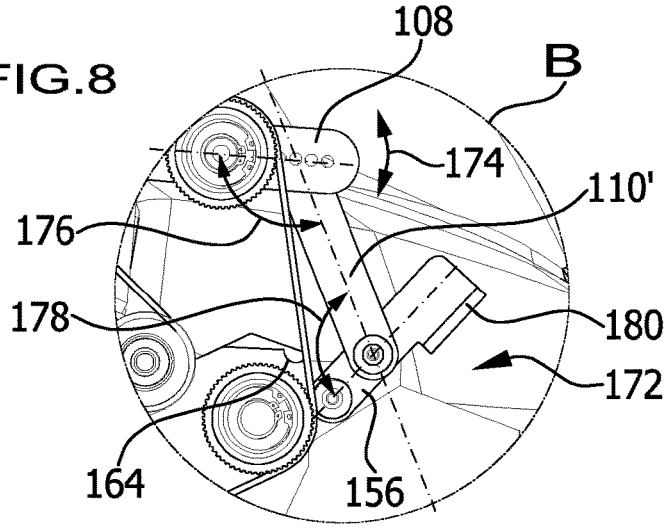
FIG. 8 shows an enlarged representation of detail B of FIG. 7.

A toggle lever is formed via the intermediate web 156 and the second web 110' (compare FIGS. 6 and 8).

In the floor cleaning machine 154, when compared with the case of the floor cleaning machine 10, the second web 110 is divided into the second web 110' and the intermediate web 156. An additional degree of freedom is thereby provided.

The intermediate web 156 comprises an articulation point to the rocker 40 via the third pivot bearing 102'. It comprises an articulation point to the second web 110' via the fifth pivot bearing 158. The second web 110' in turn comprises an articulation point to the first web 108 via the fourth pivot bearing 112 and comprises the aforementioned articulation point to the intermediate web 156 via the fifth pivot bearing 158.

In an embodiment, the second web 110' has a length between the articulation points thereof that is greater than the length of the intermediate web 156 between the articulation points thereof (compare FIG. 6).

A mechanical switch 160 is formed by which it is switchable as to whether the pivotal mobility of the first web 108 (and hence of the deflection element 106) about the second pivot axis 100 is released or blocked. Correspondingly, in the released condition, the automatic control operation described above is enabled, and in the blocked condition, the automatic control operation is not enabled.

Figure 5:
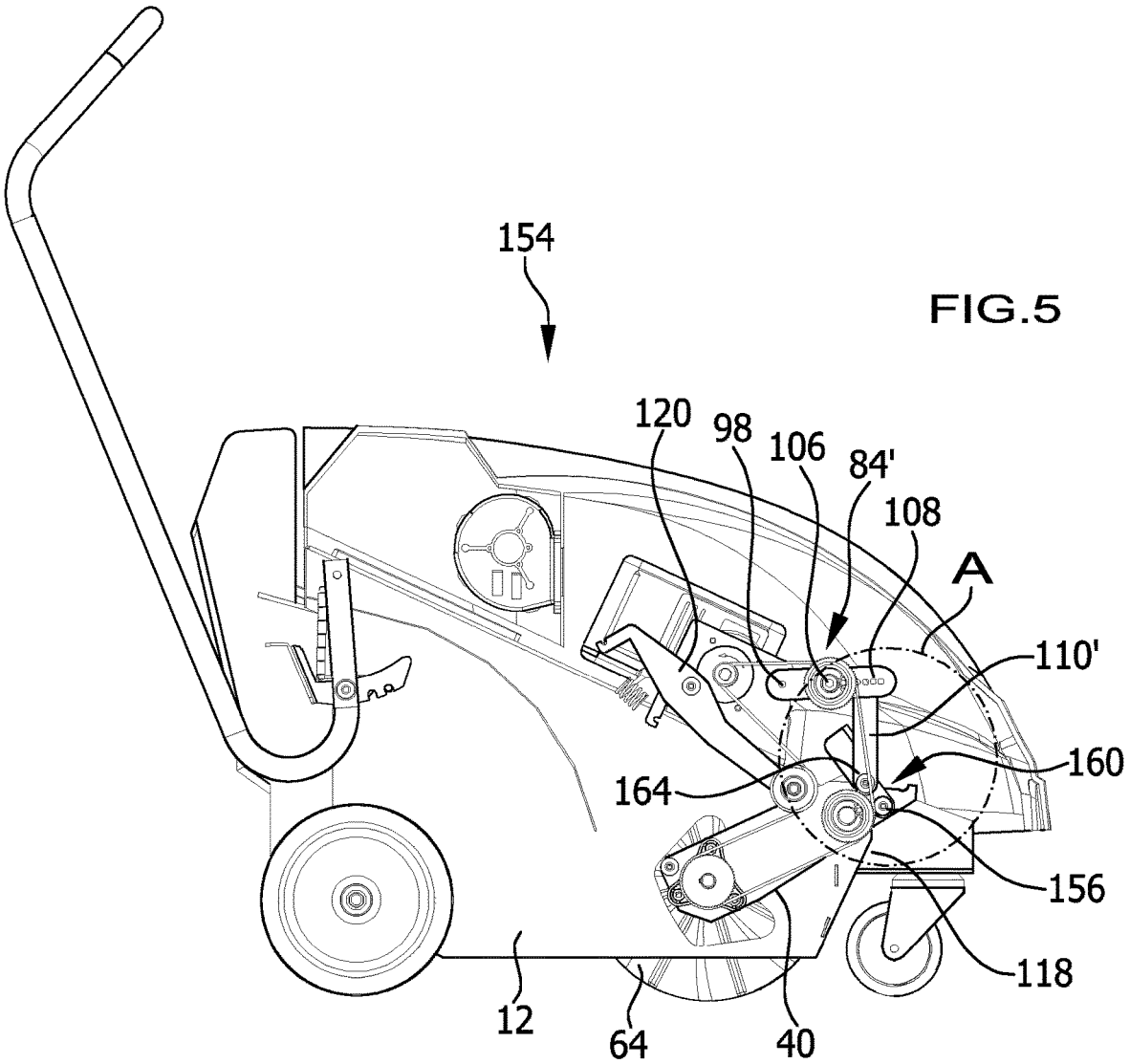
FIG. 5 shows a representation similar to FIG. 1 of a second exemplary embodiment of a floor cleaning machine in accordance with the invention, the floor cleaning machine comprising a switch, which switch is shown as being in a blocking position.

In the first position 162 of the switch 160, which is illustrated in FIGS. 5 and 6, the pivotal mobility of the first web 108, and hence of the lever 96, about the second pivot axis 100 via the second pivot bearing 98 is blocked.

In the first position 162, the toggle lever, as a combination of the intermediate web 156 and the second web 110', is in a dead center.

Figure 7:
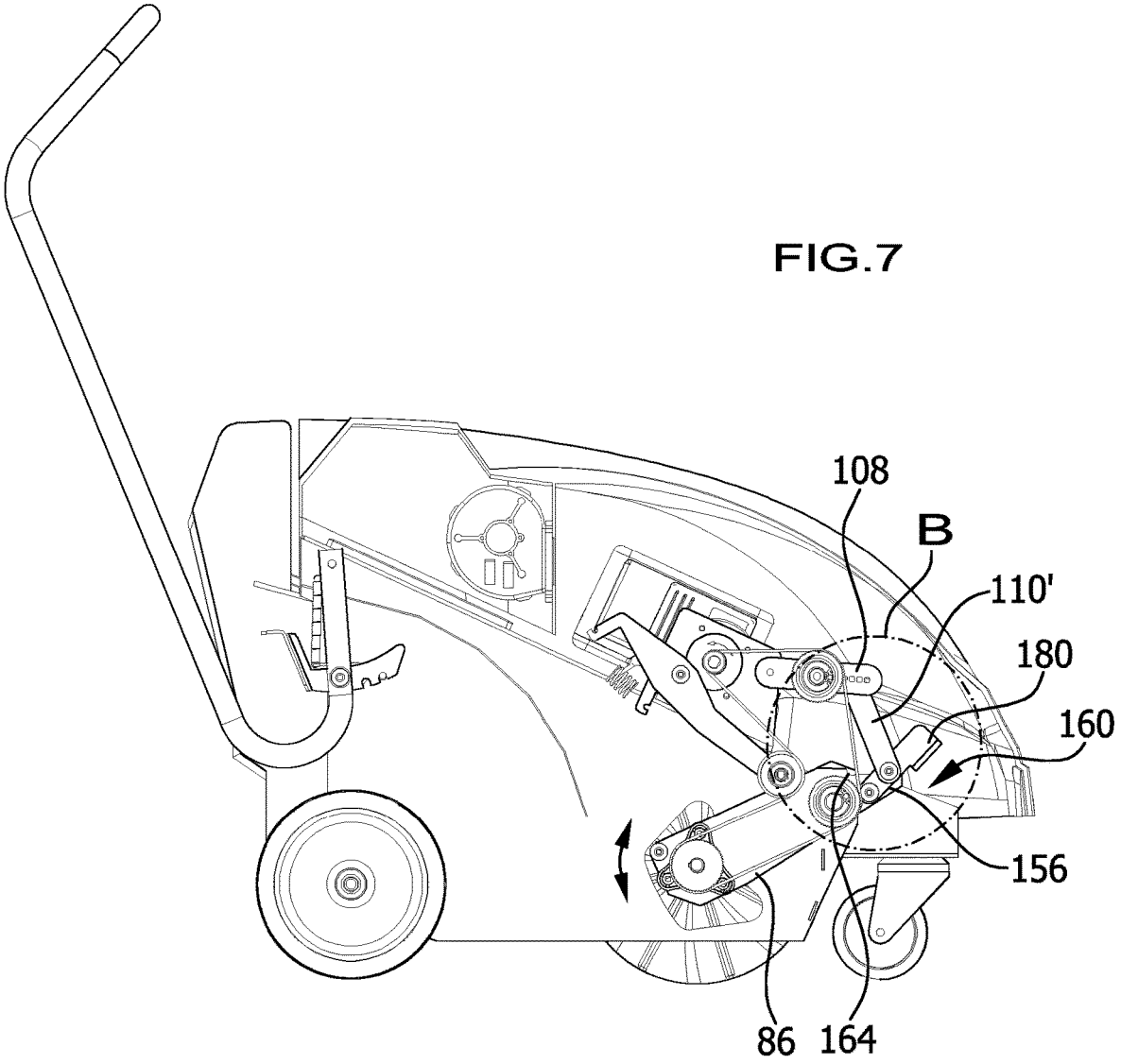
FIG. 7 shows a representation identical to that of FIG. 5, wherein the switch is in a non-blocking position.

In particular, here, provision is made for a stop 164 for the intermediate web 156 (or the second web 110') to be arranged at the base 12 or at the rocker 40 in order to predetermine the dead center of the toggle lever (compare also FIGS. 7 and 8).

In the first position 162, the pivotal position of the first web 108 is fixed by way of the second web 110' and the intermediate web 156.

The rocker 40 is free to oscillate when in the first position 162.

The deflection element 106 has a mere deflection function and does not give rise to the first web 108 adapting its position relative to the second pivot axis 100.

In the first position 162, the second web 110' is located at an acute angle 166 to the first web 108 (relative to their respective longitudinal directions) (compare FIG. 6). Here, the acute angle is related to a longitudinal axis of the web 108 and a longitudinal axis of the second web 110' with an angular orientation in a counterclockwise direction and when viewed in a top view as shown in FIG. 6.

Correspondingly, the second web 110', relative to its longitudinal axis, is located to the intermediate web 156, relative to the longitudinal axis thereof, at an obtuse angle 168.

As indicated by the double arrow 170, in the first position 162 (dead center position of the toggle lever), the pivotal mobility of the first web 108, and hence of the whole lever 96, about the second pivot axis 108 is blocked.

The switch 160 can be brought to a second position 172 (or to a plurality of second positions 172), in which a pivotal mobility of the first web 108 about the second pivot axis 100 is released. This is indicated in FIG. 8 by a double arrow designated by the reference numeral 174. When in the second position 172, the first web 108 lies at an obtuse angle 176 to the second web 110' (FIG. 8). The second web 110' lies at an acute angle 178 to the intermediate web 156.

In the second position 172 (wherein, as mentioned above, a plurality of second positions 172 can be provided), pivotal mobility of the first web 108 about the second pivot axis 100 is released. The tension in the corresponding traction member 86 can thereby predetermine the pivotal position of the first web 108 about the second pivot axis 100, wherein then, in turn, the pivotal position of the rocker 40 about the first pivot axis 44 is predetermined via the second web 110' and the intermediate web 156. The automatic control of the height position of the sweeping roller 64 in relation to the base 12 or to the floor 23 is then realized (with corresponding automatic control of the contact pressure on the floor 23 to be cleaned, or of the width of the sweeping roller 64 over which the latter acts on the floor 23 to be cleaned).

The floor cleaning machine 154 then operates in the second position 172 of the switch 160 in the same way as has been described above with reference to the floor cleaning machine 10.

An engagement region 180 for an operator is arranged at the intermediate web 156, the engagement region 180 projecting beyond the articulation point to the first web 100. Via the engagement region 180, an operator can act upon the intermediate web 156 and push it to the first position 162 or push or pull it from the first position 162 to the second position 172.

In particular, the engagement region 180 is configured such that it enables an operator to perform both a push action for a pivotal movement in one direction and a pull action for a pivotal movement in the corresponding opposite direction.

For example, starting from the first position 162, an operator can establish the second position 172 (FIGS. 7, 8) by correspondingly pivoting the intermediate web 156 by engagement with the engagement region 180, and in particular by a pull.

Starting from the second position 172 (FIGS. 7, 8), an operator can bring the intermediate web 156 to the first position 162 (FIGS. 5, 6) by pushing the intermediate web 156 by engagement with the engagement region 180.

Via the mechanical switch 160, which in the case of the floor cleaning machine 154 is realized by a toggle lever, an operator can release (second position 172) or block (first position 162) the automatic mechanical control over the traction drive 84' comprising the pivoting lever 96.

In particular, provision is made that when the automatic control is in the blocked condition, the sweeping roller 64 is free to oscillate.

In the traction drive 84 or 84' of the floor cleaning machine 10 or 154, respectively, the traction member 86 is guided on the deflection element 106 at the first web 108, on the second deflection element 118 at the rocker 40, and on the optional further deflection element 122 of the traction member tensioner 120. Torque is transmitted from the input shaft to the output shaft.

A third exemplary embodiment of a floor cleaning machine in accordance with the invention, shown in FIGS. 9 to 12 and designated therein by the reference numeral 182, comprises a traction drive 84" which is configured in generally the same manner as the traction drive 84'. The same elements are annotated with the same reference numerals.

The traction drive 84" differs from the traction drive 84' in terms of guidance of a traction member 86". The traction member 86" is guided on the corresponding roller 94, which is connected to the motor shaft 74, on the deflection element 106, which is located at the web 108, and on a roller element at the (output) shaft 82. No guidance is received from a second deflection element 118 (which is located at the first pivot bearing 42), or the second deflection element 118 is omitted entirely, compared with the traction drive 84'.

A load-side section 184 (load-side strand) of the traction member 86" is located between the roller 94 and the coupling to the shaft 82.

Figure 10:
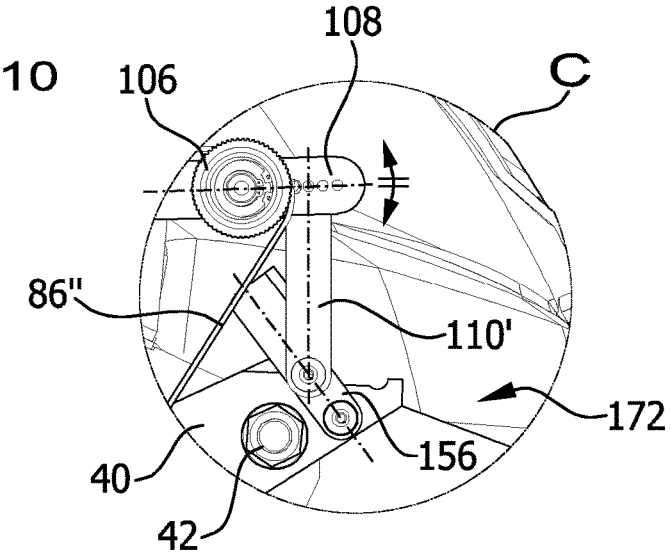
FIG. 10 shows an enlarged representation of detail C of FIG. 9.
Figure 9:
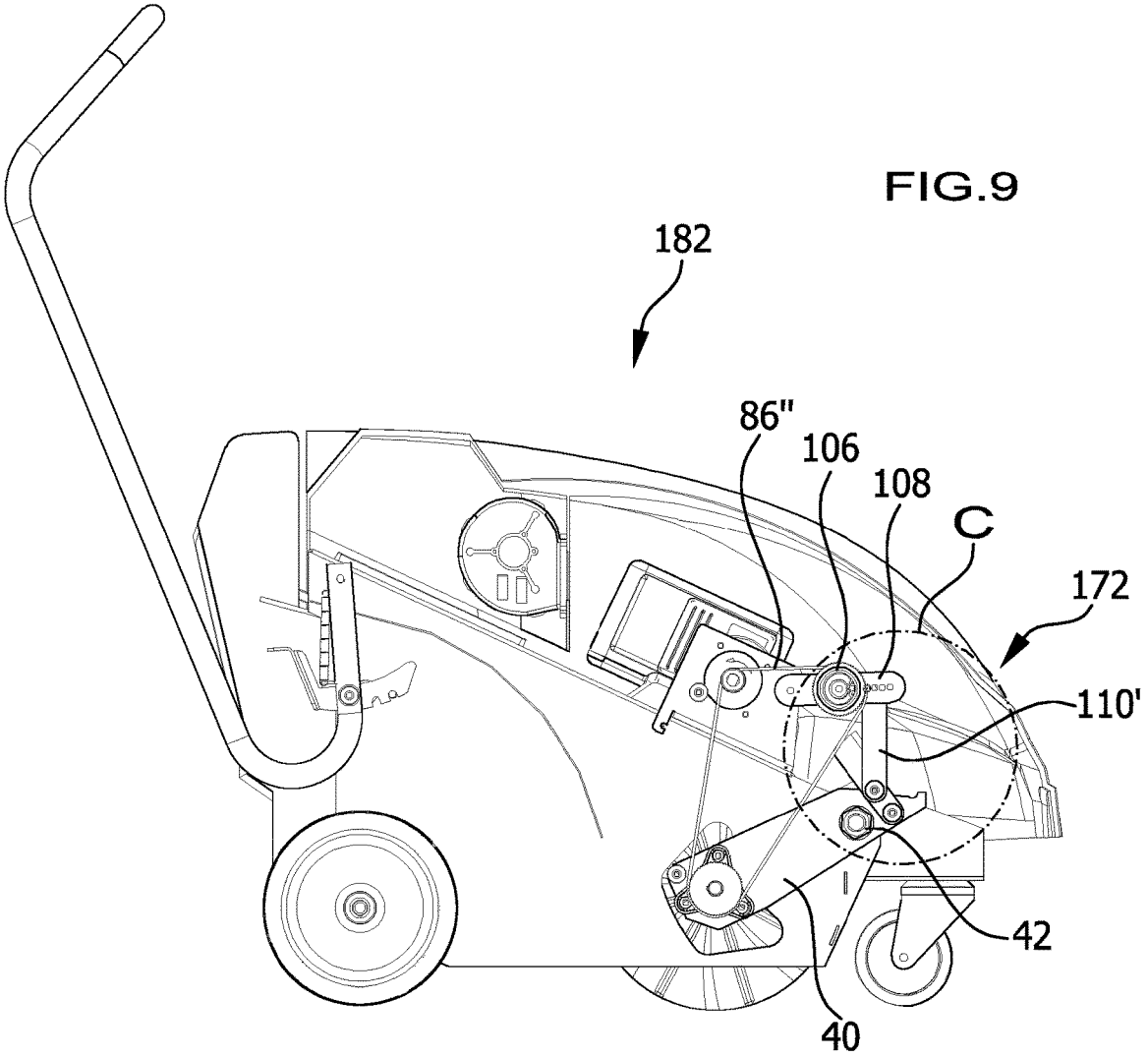
FIG. 9 shows a representation similar to FIG. 4 of a third exemplary embodiment of a floor cleaning machine in accordance with the invention, the floor cleaning machine comprising a switch, wherein the switch is shown as being in a blocking position.
Figure 12:
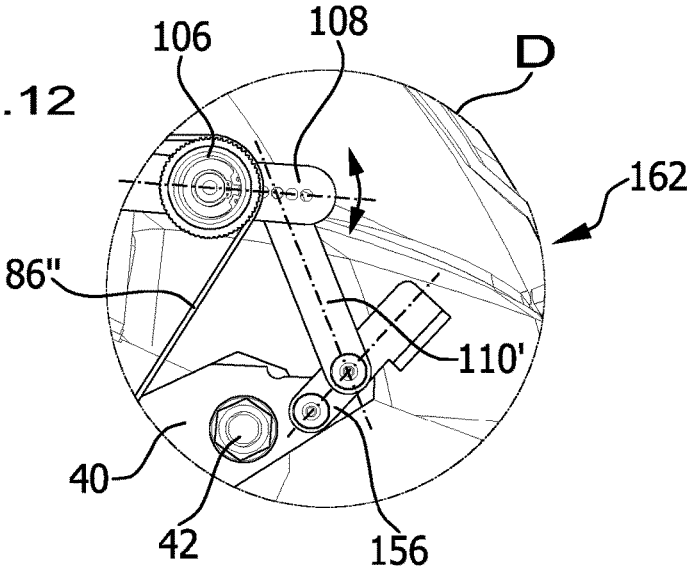
FIG. 12 shows an enlarged representation of detail D of FIG. 11.
Figure 11:
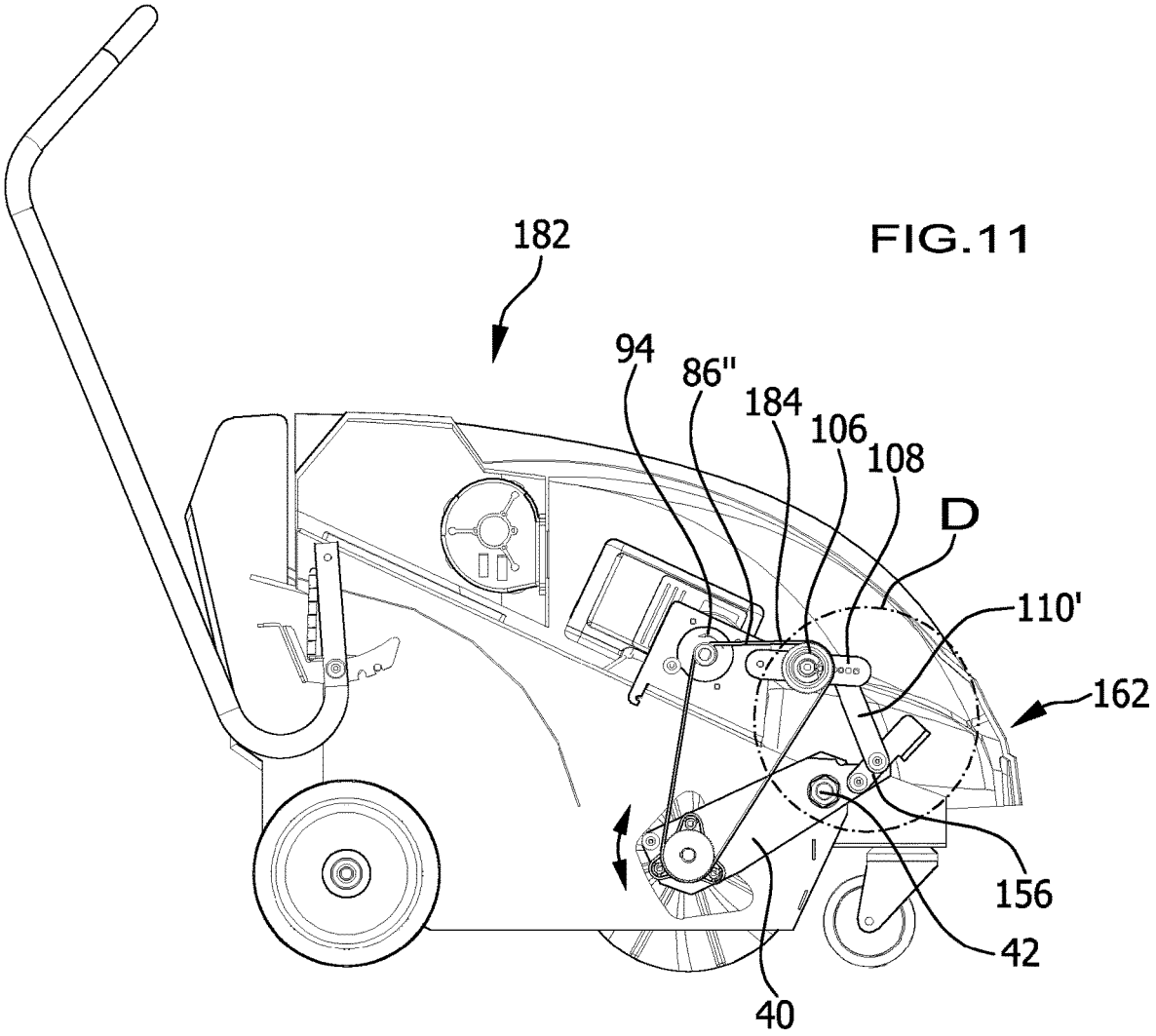
FIG. 11 shows a representation identical to that of FIG. 9, wherein the switch is in a non-blocking position.

In the illustrated exemplary embodiment, the traction drive 84" comprises the same structure of a first web 108, a second web 110' and an intermediate web 156 as that of the traction drive 84'. A mechanical switch 160 is provided having a first position 162 (FIGS. 11, 12) and a second position 172 (FIGS. 9, 10). The traction drive 84" operates in the same way as has been described above with reference to the traction drive 84'.

Mechanical control is the same as that described above in conjunction with the floor cleaning machine 10 or 154. Also, in the case of the traction drive 84", even when providing guidance of the traction member 86" in the manner just explained, the effect can be achieved that, via the tension in the load-side section 184, (in the second position 172 of the switch 160) the first web 180 is adapted in its position, and, hence, the position of the rocker 40 relative to the first pivot axis 44 is correspondingly adapted, in order to thus adjust a contact pressure of the sweeping roller 64 against a floor to be cleaned, or to adjust a width over which the sweeping roller 64 acts on the floor to be cleaned.

The traction drive 84" has been described in connection with a switch 160. It is also possible, for example, for a guiding course as that described for the traction member 86" to exist without a switch 160 (compare FIG. 4).

Figure 14:
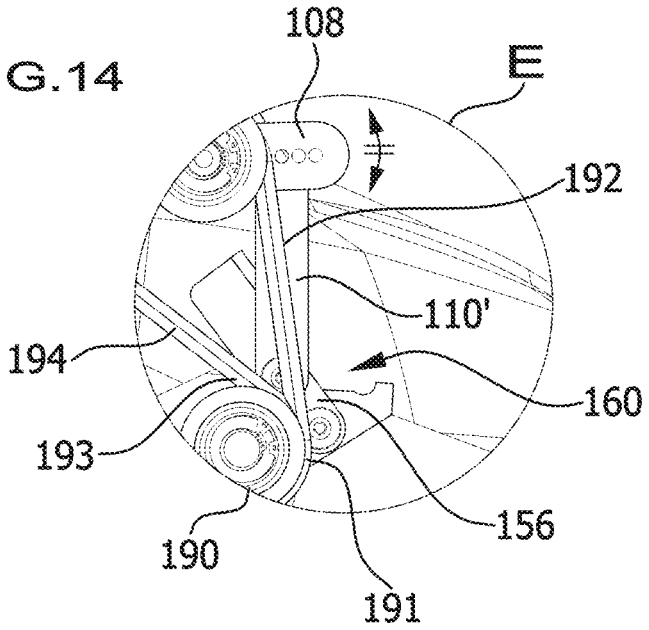
FIG. 14 shows an enlarged representation of detail E of FIG. 13.
Figure 13:
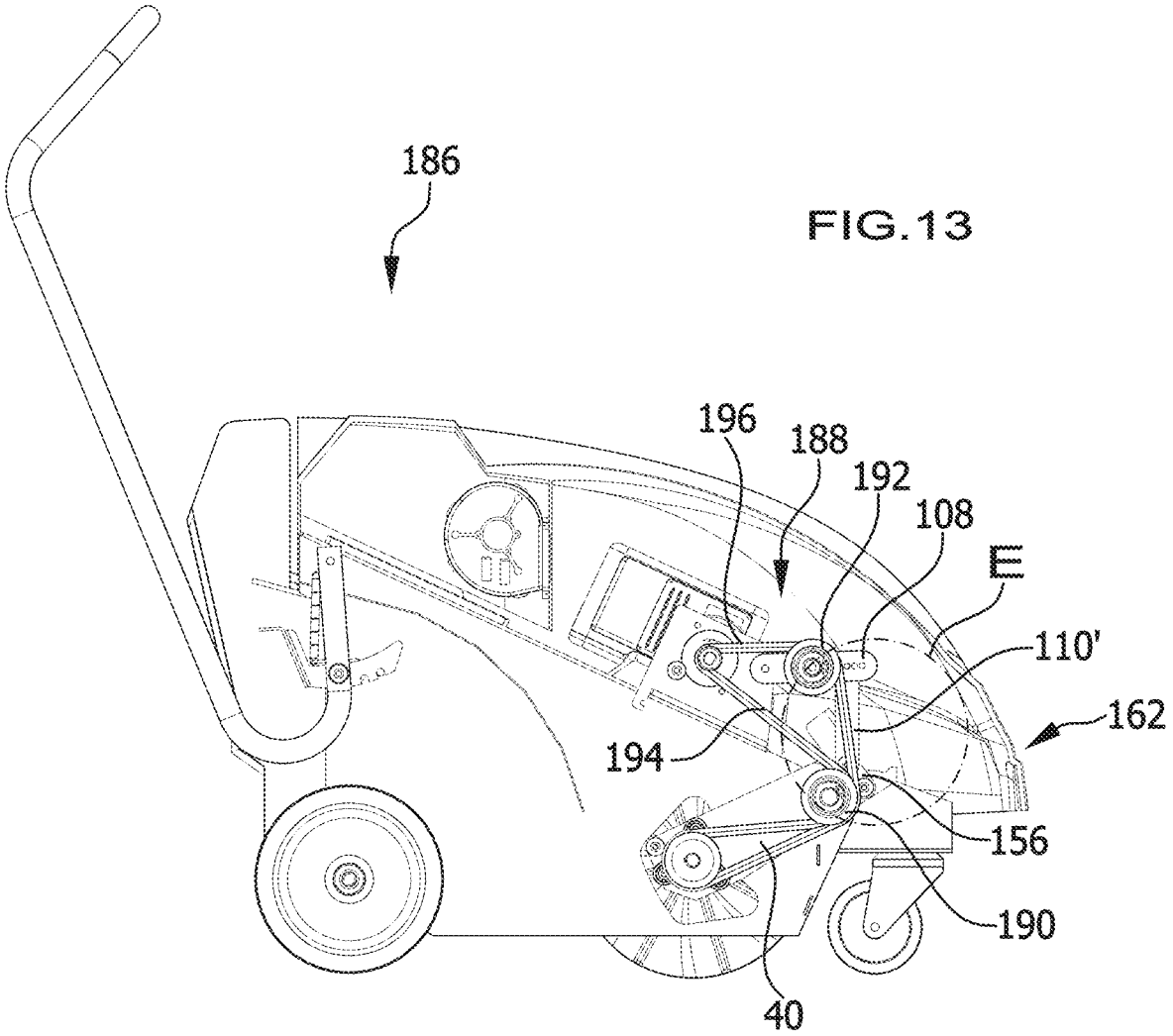
FIG. 13 shows a representation similar to FIG. 4 of a fourth exemplary embodiment of a floor cleaning machine in accordance with the invention, the floor cleaning machine comprising a switch, wherein the switch is shown as being in a blocking position.
Figure 15:
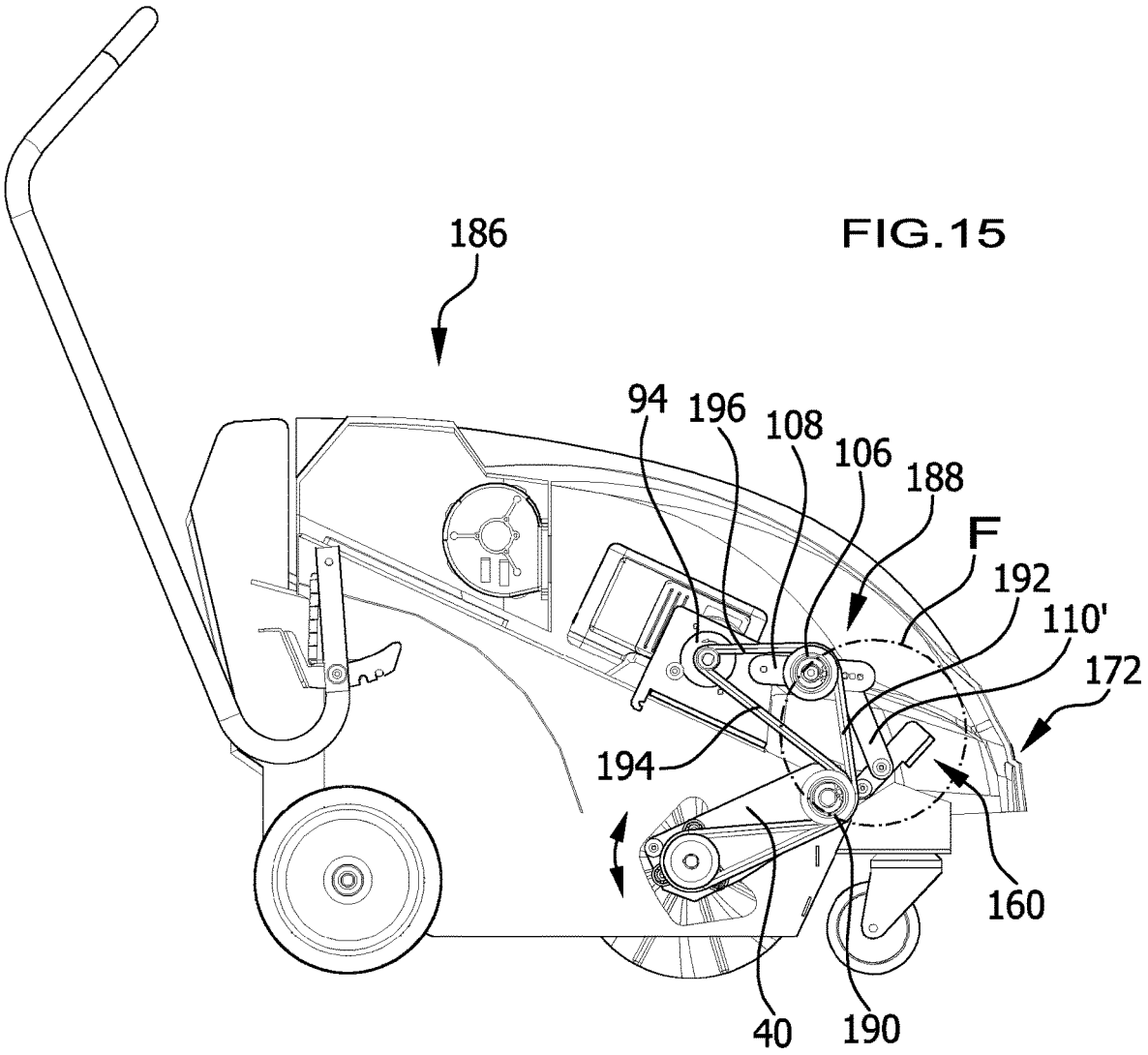
FIG. 15 shows a representation identical to that of FIG. 13, except that the switch is shown as being in a non-blocking position.

A further exemplary embodiment of a floor cleaning machine in accordance with the invention, shown in FIGS. 13 to 15 and designated therein by the reference numeral 186, comprises a traction drive 188 which is configured in generally the same manner as the traction drive 84'. The same elements are annotated with the same reference numerals. A first web 108, a second web 110' articulated thereto, and an intermediate web 156 are provided. A switch 160 is thereby formed.

Figure 16:
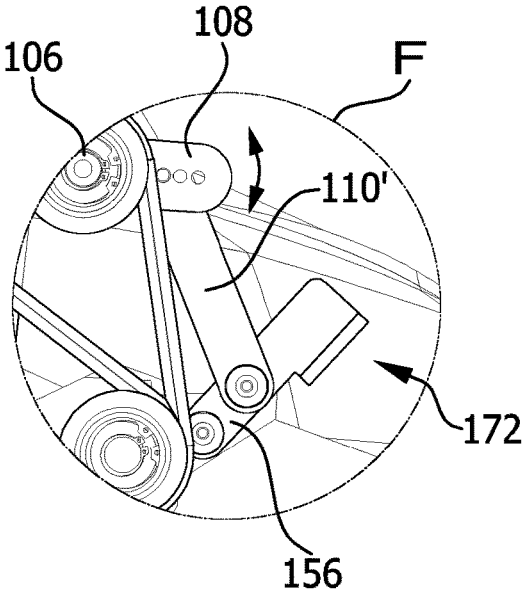
FIG. 16 shows an enlarged representation of detail F of FIG. 15.

The first position 162 of the switch 160 is shown in FIGS. 13, 14. The second position 172 of the switch 160 is shown in FIGS. 15, 16.

Arranged at the rocker 40, and, here, at the first pivot bearing 42, is a second deflection element 190 which is configured as a deflection roller in particular. The second deflection element 190 provides guidance to both a load-side section 192 and a slack-side section 194 of a traction member 196. In particular, the second deflection element 190 comprises a first track 191 for the load-side section 192 and, separate therefrom, a second track 193 for the slack-side section 194.

The second deflection element 190 can also be used as a traction tensioner on which the slack-side section 194 of the traction member 196 is guided.

The traction member 196 is thereby guided, in the load-side section 192 thereof, from the roller 94, via the deflection element 106, on the second deflection element 190 at the rocker 40, and to the roller element which is connected to the shaft 82.

From this roller element, the traction member 196 is guided in the slack-side section 194 thereof via the second deflection element 190 (by the second pathway thereof) and to the roller 94.

As in the exemplary embodiments described above, an automatic control of the contact pressure of the sweeping roller 64 against the floor to be cleaned can be performed when the switch 160 is in the second position 172.

In the traction drive 188, the guidance of the traction member 196 can also be realized without a mechanical switch 160 being provided.

LIST OF REFERENCE CHARACTERS

10 floor cleaning machine (first exemplary embodiment)
12 base

14 chassis
16 front end
18 rear end
20 axis
22 forward (travel) direction
23 floor
24 wheel device
26 rear wheel device
28 front wheel device
30*a* left rear wheel
30*b* right rear wheel
32 wheel axis
34 roller
36 sweeping roller unit
38 underside
40 rocker
42 first pivot bearing
44 first pivot axis
46 first arm
48 second arm
50 bar
52 height direction
54 first lug
56 second lug
58 holder
60 lug device
62 openings
64 sweeping roller
66 rotary bearing
68 rotary axis
70 plane of support
72 motor device
74 motor shaft
76 axis of rotation
78 drive device
80 torque transmission device
82 shaft
84 traction drive
84' traction drive
84" traction drive
86 traction member
86" traction member
88 load-side section
90 slack-side section
92 holder
94 roller
96 lever
98 second pivot bearing
100 second pivot axis
102 third pivot bearing
102' third pivot bearing
102" third pivot bearing
104 third pivot axis
106 deflection element
108 first web
110 second web
110' second web
112 fourth pivot bearing
114 fourth pivot axis
116 longitudinal direction
118 second deflection element
120 traction member tensioner
122 further deflection element
124 battery device
126 receptacle
128 dirt collection container
130 overthrow guide
132 direction of rotation
134 suction unit device
136 filter unit
138 filter cleaning device
140 housing cover
142 holder
144 holding bar
146*a* first strut
146*b* second strut
148 double arrow
150 double arrow
152 double arrow
154 floor cleaning machine (second exemplary embodiment)
156 intermediate web
158 fifth pivot bearing
160 switch
162 first position
164 stop
166 acute angle
168 obtuse angle
170 double arrow
172 second position
174 double arrow
176 obtuse angle
178 acute angle
180 engagement region
182 floor cleaning machine (third exemplary embodiment)
184 load-side section
186 floor cleaning machine (fourth exemplary embodiment)
188 traction drive
190 second deflection element
192 load-side section
194 slack-side section
196 traction member

The invention claimed is:

1. A floor cleaning machine, comprising:

a base;

a rocker which is arranged at the base via a first pivot bearing for pivotal movement about a first pivot axis;

a sweeping roller which is arranged at the rocker via a rotary bearing for rotational movement about a rotary axis;

a motor device for rotatably driving the sweeping roller; and a traction drive having a traction member for transmitting torque from the motor device to the sweeping roller;

wherein the traction member comprises a load-side section;

wherein a lever is arranged at the base via a second pivot bearing for pivotal movement about a second pivot axis;

wherein the lever is articulated to the rocker;

wherein a deflection element for the traction member is arranged at the lever;

wherein the traction member is guided on the deflection element in the load-side section, and wherein the lever comprises a first web which is articulated to the base via the second pivot bearing, and comprises a second web which is connected to the first web via a fourth pivot bearing for pivotal movement about a fourth pivot axis and which is oriented transversely to the first web.

2. The floor cleaning machine in accordance with claim 1, wherein the lever is articulated to the rocker via a third pivot bearing for pivotal movement about a third pivot axis.

3. The floor cleaning machine in accordance with claim 2, wherein the third pivot axis is oriented parallel to at least one of the rotary axis, the first pivot axis and the second pivot axis.

4. The floor cleaning machine in accordance with claim 2, wherein, relative to a longitudinal direction of the rocker, the first pivot bearing is positioned between the rotary bearing and the third pivot bearing.

5. The floor cleaning machine in accordance with claim 1, wherein at least one of the following is provided:

the rotary axis and the first pivot axis are oriented parallel to one another;

the rotary axis and the second pivot axis are oriented parallel to each other;

the first pivot axis and the second pivot axis are oriented parallel to one another;

at least one of the rotary axis, the first pivot axis and the second pivot axis are transverse to a forward travel direction of the floor cleaning machine;

at least one of the rotary axis, the first pivot axis and the second pivot axis are parallel to a wheel axis of the floor cleaning machine;

at least one of the rotary axis, the first pivot axis and the second pivot axis are transverse to a height direction of the base, wherein a position of the sweeping roller in the height direction is adjustable via a pivotal position of the rocker on the first pivot bearing.

6. The floor cleaning machine in accordance with claim 1, wherein, relative to a longitudinal direction of the rocker, the first pivot bearing is positioned spaced apart from the rotary bearing.

7. The floor cleaning machine in accordance with claim 1, wherein the lever is arranged and configured such that its pivotal position about the second pivot axis predetermines a pivotal position of the rocker about the first pivot axis, and predetermines at least one of the following:

a height position of the sweeping roller relative to the base;

a contact pressure of the sweeping roller against a floor to be cleaned;

a width over which the sweeping roller acts on a floor to be cleaned.

8. The floor cleaning machine in accordance with claim 1, wherein the lever is arranged and configured such that, when in a cleaning mode in which the sweeping roller acts on a floor to be cleaned, a pivotal position of the lever on the second pivot bearing is adjusted via a resultant force in the load-side section of the traction member, wherein the resultant force in the load-side section is determined by a torque of the sweeping roller on the floor to be cleaned.

9. The floor cleaning machine in accordance with claim 1, wherein a positioning device is provided for positioning, via the rocker, the sweeping roller on a floor to be cleaned, wherein the positioning comprises automatic control via the lever.

10. The floor cleaning machine in accordance with claim 1, wherein the second web is connected to the first web in translationally fixed relation thereto, or is, relative to a translational position at the first web, adjustably connected to, and translationally fixed to, the first web.

11. The floor cleaning machine in accordance with claim 10, wherein at least two discrete translational positions are provided, in each of which the second web is fixable to the first web in translationally fixed relation thereto.

12. The floor cleaning machine in accordance with claim 1, wherein the second web is coupled to the rocker.

13. The floor cleaning machine in accordance with claim 12, wherein the second web is directly pivotably articulated to the rocker, and is pivotably connected to the rocker via a third pivot bearing having a third pivot axis.

14. The floor cleaning machine in accordance with claim 12, wherein the second web is pivotably articulated to an intermediate web, and wherein the intermediate web is pivotably articulated to the rocker, wherein the intermediate web is coupled to the rocker via a third pivot bearing for pivotal movement about a third pivot axis, and the second web is articulated to the intermediate web via a fifth pivot bearing for pivotal movement about a fifth pivot axis.

15. The floor cleaning machine in accordance with claim 14, wherein the intermediate web to has a length between an articulation point to the second web and an articulation point to the rocker shorter than a length of the second web between an articulation point to the first web and the articulation point to the intermediate web.

16. The floor cleaning machine in accordance with claim 14, wherein at least one of the following is provided:

a mechanical switch is formed by way of the intermediate web, via which mechanical switch a pivotability of the lever about the second pivot axis is blockable;

the switch has at least one first position in which a pivotal mobility of the lever about the second pivot axis is blocked;

in the at least one first position of the switch, the rocker is free to pivot about the first pivot axis;

in the at least one first position, the second web is oriented at an acute angle to the first web;

in the at least one first position, the intermediate web is oriented at an obtuse angle to the second web;

the switch has at least one second position in which pivotability of the lever about the second pivot axis is enabled;

in the at least one second position, the second web is oriented at an obtuse angle to the first web;

in the at least one second position, the intermediate web is oriented at an acute angle to the second web;

the second web and the intermediate web form a toggle lever;

the intermediate web comprises an engagement region for an operator which is configured such that the intermediate web is at least one of (i) pushable by an operator and (ii) pullable by an operator.

17. The floor cleaning machine in accordance with claim 1, wherein the deflection element is located at the first web.

18. The floor cleaning machine in accordance with claim 1, wherein the traction drive has associated therewith a switch, by way of which a pivotal mobility of the lever about the second pivot axis is blockable.

19. The floor cleaning machine in accordance with claim 18, wherein, when the pivotal mobility of the lever is blocked by the switch, the rocker is supported for oscillating motion on the base.

20. The floor cleaning machine in accordance with claim 18, wherein at least one of the following is provided:

the switch is configured as a pivoting switch;

the switch has a dead center or dead center region, wherein, in the dead center or the dead center region, the pivotal mobility of the lever about the second pivot axis is blocked;

the switch is pushable in its pivotal movement and is pullable in a pivotal movement by a user.

21. The floor cleaning machine in accordance with claim 1, wherein the rocker comprises a first arm and a spaced-apart second arm, wherein the sweeping roller is rotatably supported on the first arm and the second arm via the rotary bearing.

22. The floor cleaning machine in accordance with claim 21, wherein a bar is connected to the first arm and the second arm, and the bar is supported on the base for forming the first pivot bearing.

23. The floor cleaning machine in accordance with claim 22, wherein the bar is arranged in the area of a front end of the base, relative to a forward travel direction of the floor cleaning machine.

24. The floor cleaning machine in accordance with claim 1, wherein the traction drive has, relative to the sweeping roller, a single-sided configuration.

25. The floor cleaning machine in accordance with claim 1, wherein the traction drive comprises a traction member tensioner which is associated with a slack-side section of the traction member.

26. The floor cleaning machine in accordance with claim 1, wherein the traction drive comprises a drive element of the motor device, the deflection element at the lever, and an output element for the sweeping roller, and comprises the traction member, wherein the traction member is a closed loop traction member.

27. The floor cleaning machine in accordance with claim 26, wherein the traction drive comprises a second deflection element which is arranged at the rocker.

28. The floor cleaning machine in accordance with claim 27, wherein the second deflection element is arranged at the first pivot bearing.

29. The floor cleaning machine in accordance with claim 27, wherein the second deflection element comprises a first track for the load-side section of the traction member and a second track for a slack-side section of the traction member.

30. The floor cleaning machine in accordance with claim 1, wherein the traction member is a belt or a chain.

31. The floor cleaning machine in accordance with claim 1, wherein a rechargeable battery device is provided for providing electrical energy to the motor device.

32. The floor cleaning machine in accordance with claim 31, wherein a first receptacle for a first battery of the battery device is arranged at the base and a second receptacle for a second battery is arranged at the base, separate from the first receptacle, wherein the first battery positioned at the first receptacle is operative with respect to the delivery of electrical energy to the motor device, and the second battery positioned on the second receptacle is a replacement battery.

33. The floor cleaning machine in accordance with claim 1, wherein at least one of the following is provided:

the floor cleaning machine is configured as a sweeping machine for textile floors;

a suction unit device is associated with the sweeping roller;

a wheel device is arranged at the base for mobile operation of the floor cleaning machine;

in operation of the floor cleaning machine, the floor cleaning machine is supported by the wheel device on the floor to be cleaned;

the sweeping roller is positioned at the base, between a front end of the base and a rear wheel device;

the floor cleaning machine is configured as a walk-behind machine or as a ride-on machine;

a holder for an operator is arranged at the base.

34. The floor cleaning machine in accordance with claim 1, wherein a dirt collection container is provided to which dirt is conveyable from the sweeping roller with at least one of the following:

the conveyance of dirt is assisted by a suction flow from a suction unit device;

provision is made for an overthrow guide for dirt from the sweeping roller to the dirt collection container;

the dirt collection container is removably arranged at the base;

the dirt collection container is arranged on a rear side of the base.

35. A method for operating a floor cleaning machine, said method comprising:

providing a floor cleaning machine comprising:

a base;

a rocker which is arranged at the base via a first pivot bearing for pivotal movement about a first pivot axis;

a sweeping roller which is arranged at the rocker via a rotary bearing for rotational movement about a rotary axis;

a motor device for rotatably driving the sweeping roller; and a traction drive having a traction member for transmitting torque from the motor device to the sweeping roller;

wherein the traction member comprises a load-side section;

wherein a lever is arranged at the base via a second pivot bearing for pivotal movement about a second pivot axis;

wherein the lever is articulated to the rocker;

wherein a deflection element for the traction member is arranged at the lever; and wherein the traction member is guided on the deflection element in the load-side section, the method comprising:

mechanically controlling an action of the sweeping roller on a floor to be cleaned;

wherein a pivotal position of the lever on the second pivot bearing is predetermined via an application of force on the load-side section of the traction member, wherein the pivotal position of the lever on the second pivot bearing predetermines the position of the rocker on the first pivot bearing, and wherein the lever comprises a first web which is articulated to the base via the second pivot bearing, and comprises a second web which is connected to the first web via a fourth pivot bearing for pivotal movement about a fourth pivot axis and which is oriented transversely to the first web.

* * * * *